US010397722B2

(12) United States Patent
Eronen et al.

(10) Patent No.: US 10,397,722 B2
(45) Date of Patent: Aug. 27, 2019

(54) DISTRIBUTED AUDIO CAPTURE AND MIXING

(71) Applicant: Nokia Technologies Oy, Espoo (FI)

(72) Inventors: Antti Eronen, Tampere (FI); Jussi Leppanen, Tampere (FI); Arto Lehtiniemi, Lempaala (FI); Matti Hamalainen, Lempaala (FI); Sujeet Mate, Tampere (FI); Francesco Cricri, Tampere (FI); Mikko-Ville Laitinen, Helsinki (FI); Mikko Tammi, Tampere (FI); Ville-Veikko Mattila, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/767,458

(22) PCT Filed: Oct. 11, 2016

(86) PCT No.: PCT/FI2016/050712
§ 371 (c)(1),
(2) Date: Apr. 11, 2018

(87) PCT Pub. No.: WO2017/064368
PCT Pub. Date: Apr. 20, 2017

(65) Prior Publication Data

US 2018/0310114 A1 Oct. 25, 2018

(30) Foreign Application Priority Data

Oct. 12, 2015 (GB) ..... 1518025.0

(51) Int. Cl.
*H04R 5/02* (2006.01)
*H04S 7/00* (2006.01)
(Continued)

(52) U.S. Cl.
CPC ..... *H04S 7/303* (2013.01); *H04R 1/406* (2013.01); *H04R 3/005* (2013.01); *H04R 5/027* (2013.01);
(Continued)

(58) Field of Classification Search
CPC ..... H04S 7/303; H04R 1/406
See application file for complete search history.

(56) References Cited

U.S. PATENT DOCUMENTS 9,237,398 B1 * 1/2016 Algazi ..... H04S 7/304
2005/0147261 A1 * 7/2005 Yeh ..... H04M 3/567 381/92

(Continued)

FOREIGN PATENT DOCUMENTS

WO WO 2014/096900 A1 6/2014
WO WO-2014/165326 A1 10/2014

OTHER PUBLICATIONS

Braasch, Jonas, et al., "Mixing Console Design Considerations for Telematic Music Applications", Audio Engineering Society Convention Paper, Oct. 9-12, 2009, full text.

(Continued)

*Primary Examiner* — Simon King
(74) *Attorney, Agent, or Firm* — Harrington & Smith

(57) ABSTRACT

Apparatus including a processor configured to: receive a spatial audio signal associated with a microphone array configured to provide spatial audio capture and at least one additional audio signal associated with an additional microphone, the at least one additional microphone signal having been delayed by a variable delay determined such that the audio signals are time aligned; receive a relative position between a first position associated with the microphone array and a second position associated with the additional microphone; generate at least two output audio channel (Continued)

signals by processing and mixing the spatial audio signal and the at least one additional audio signal based on the relative position between the first position and the second position such that the at least two output audio channel signals present an augmented audio scene.

20 Claims, 11 Drawing Sheets

(51) Int. Cl.
*H04R 1/40* (2006.01)
*H04R 3/00* (2006.01)
*H04R 5/027* (2006.01)

(52) U.S. Cl.
CPC ..... *H04R 2430/23* (2013.01); *H04S 2400/01* (2013.01); *H04S 2400/11* (2013.01); *H04S 2400/15* (2013.01); *H04S 2420/01* (2013.01)

(56) References Cited

U.S. PATENT DOCUMENTS

| | | | | |
|---|---|---|---|---|
| 2009/0264114 | A1 | 10/2009 | Virolainen et al. | 455/416 |
| 2009/0313028 | A1 | 12/2009 | Tammi et al. | 704/500 |
| 2011/0301730 | A1 | 12/2011 | Kemp et al. | 700/94 |
| 2012/0128174 | A1* | 5/2012 | Tammi | H04S 1/002 381/92 |
| 2013/0044884 | A1 | 2/2013 | Tammi et al. | 381/26 |
| 2013/0094683 | A1* | 4/2013 | Hansen | G09B 21/04 381/309 |
| 2014/0198918 | A1 | 7/2014 | Li et al. | 381/26 |
| 2014/0285312 | A1 | 9/2014 | Laaksonen et al. | 340/4.42 |
| 2016/0266865 | A1* | 9/2016 | Tsingos | H04S 7/304 |
| 2016/0269849 | A1* | 9/2016 | Riggs | H04S 7/304 |

OTHER PUBLICATIONS

Braasch, Jonas, et al., "Mixing Console Design Considerations for Telematic Music Applications", Audio Engineering Society Convention Paper, Oct. 9-12, 2009, abstract.

* cited by examiner

DISTRIBUTED AUDIO CAPTURE AND MIXING

FIELD

The present application relates to apparatus and methods for distributed audio capture and mixing. The invention further relates to, but is not limited to, apparatus and methods for distributed audio capture and mixing for spatial processing of audio signals to enable spatial reproduction of audio signals.

BACKGROUND

Capture of audio signals from multiple sources and mixing of those audio signals when these sources are moving in the spatial field requires significant manual effort. For example the capture and mixing of an audio signal source such as a speaker or artist within an audio environment such as a theatre or lecture hall to be presented to a listener and produce an effective audio atmosphere requires significant investment in equipment and training.

A commonly implemented system would be for a professional producer to utilize a close microphone, for example a Lavalier microphone worn by the user or a microphone attached to a boom pole to capture audio signals close to the speaker or other sources, and then manually mix this captured audio signal with a suitable spatial (or environmental or audio field) audio signal such that the produced sound comes from an intended direction. As would be expected manually positioning a sound source within the spatial audio field requires significant time and effort to do manually. Furthermore such professionally produced mixes are not particularly flexible and cannot easily be modified by the end user. For example to 'move' the close microphone audio signal within the environment further mixing adjustments are required in order that the source and the audio field signals do not produce a perceived clash.

Thus, there is a need to develop solutions which automate part or all of the spatial audio capture, mixing and sound track creation process.

SUMMARY

There is provided according to a first aspect an apparatus comprising a processor configured to: receive a spatial audio signal associated with a microphone array configured to provide spatial audio capture and at least one additional audio signal associated with an additional microphone, the at least one additional microphone signal having been delayed by a variable delay determined such that the spatial audio signal and the at least one additional microphone signal are time aligned; receive a relative position between a first position associated with the microphone array and a second position associated with the additional microphone; generate at least two output audio channel signals by processing and mixing the spatial audio signal and the at least one additional audio signal based on the relative position between the first position and the second position such that the at least two output audio channel signals present an augmented audio scene.

The processor may be configured to mix and process the spatial audio signal and the at least one additional audio signal such that a perception of a captured by the spatial audio signal and the at least one additional microphone signal is enhanced.

The processor may be configured to mix and process the spatial audio signal and the at least one additional audio signal such that a spatial positioning of a source captured by the spatial audio signal and the at least one additional microphone signal as perceived by a listener is changed.

The processor configured to generate the at least two output audio channel signals by processing and mixing the spatial audio signal and the at least one additional audio signal based on a relative position between the first position and the second position may be further configured to combine the spatial audio signal and the at least one additional audio signal in a ratio defined by a distance defined by the relative position between the first position associated with the microphone array and the second position associated with the additional microphone.

The processor may be further configured to receive a user input defining an orientation of a listener, and the processor configured to generate the at least two output audio channel signals by processing and mixing may be further configured to generate the at least two output audio channel signals by processing and mixing the spatial audio signal and at least one additional audio signal based further on the user input.

The processor configured to generate the at least two output audio channel signals may be configured to generate at least one binaural rendering of the at least one additional audio signal by being configured to: determine a head related transfer function based on the relative position; apply the head related transfer function to the at least one additional audio signal to generate a first pair of binaural audio signals; apply a plurality of fixed further head related transfer functions to a decorrelated additional audio signal to generate further pairs of binaural audio signals; and combine the first and further pairs of binaural audio signals to generate the at least one binaural rendering of the at least one additional audio signal.

The processor configured to apply the head related transfer function to the at least one additional audio signal to generate a first pair of binaural audio signals may be further configured to apply a direct gain to the at least one additional audio signal before the application of the head related transfer function and the processor configured to apply a plurality of fixed further head related transfer functions may be further configured to apply a wet gain to the at least one additional audio signal before the application of the plurality of the fixed further head related transfer function.

The processor may be configured to determine a ratio of the direct gain to the wet gain based on the distance between the first position and the second position.

The processor configured to generate the at least two output audio channel signals may be further configured to generate at least one binaural rendering of the spatial audio signal by being configured to: determine a head related transfer function based on a spatial audio signal channel orientation; apply the head related transfer function to a spatial audio signal associated with the spatial audio signal channel orientation to generate a first pair of binaural spatial audio signals; apply a plurality of fixed further head related transfer functions to a decorrelated spatial audio signal associated with the spatial audio signal channel orientation to generate further pairs of binaural spatial audio signals; and combine the first and further pairs of binaural spatial audio signals to generate the at least one binaural rendering of the spatial audio signal.

The processor configured to generate the at least two output audio channel signals may be further configured to generate a binaural rendering for each channel of the spatial audio signal.

The processor configured to generate the at least two output audio channel signals may be further configured to combine the at least one binaural rendering of the spatial audio signal and the at least one binaural rendering of the at least one additional audio signal.

According to a second aspect there is provided apparatus comprising a processor configured to: determine a spatial audio signal captured by a microphone array at a first position configured to provide spatial audio capture; determine at least one additional audio signal captured by an additional microphone at a second position; determine and track a relative position between the first position and the second position; determine a variable delay between the spatial audio signal and at least one additional audio signal such that the audio signals are time aligned; apply the variable delay to the at least one additional audio signal to substantially align the spatial audio signal and the at least one additional audio signal.

The processor may be further configured to output or store: the spatial audio signal; the at least one additional audio signal delayed by the variable delay; and the relative position between the first position and the second position.

The microphone array may be associated with a first position tag identifying the first position, and the additional microphone may be associated with a second position tag identifying the second position, wherein the processor configured to determine and track a relative position may be configured to determine the relative position based on a comparison of the first position tag and the second position tag.

The processor configured to determine the variable delay may be configured to determine a maximum correlation value between the spatial audio signal and the at least one additional audio signal and determine the variable delay as a time value associated with the maximum correlation value.

The processor may be configured to perform a correlation on the spatial audio signal and the at least one additional audio signal over a range of time values centred at a time value based on a time required for sound to travel over a distance between the first position and the second position.

The processor configured to determine and track a relative position between the first position and the second position may be configured to: determine the first position defining the position of the microphone array; determine the second position defining the position of the at least one additional microphone; determine a relative distance between the first position and the second position; and determine at least one orientation difference between the first position and the second position.

An apparatus may comprise: a capture apparatus as described herein; and a render apparatus as described herein.

The variable delay between the spatial audio signal and at least one additional audio signal such that the audio signals are time aligned may enable the restoration of synchronisation between the spatial audio signal and the at least one additional audio signal.

The at least one additional microphone may comprise at least one of: a microphone physically separate from the microphone array; a microphone external to the microphone array; a Lavalier microphone; a microphone coupled to a person configured to capture the person's audio output; a microphone coupled to an instrument; a hand held microphone; a lapel microphone; and a further microphone array.

According to a third aspect there is provided a method comprising: receiving a spatial audio signal associated with a microphone array configured to provide spatial audio capture and at least one additional audio signal associated with an additional microphone, the at least one additional microphone signal having been delayed by a variable delay determined such that the spatial audio signal and the at least one additional microphone signal are time aligned; receiving a relative position between a first position associated with the microphone array and a second position associated with the additional microphone; generating at least two output audio channel signals by processing and mixing the spatial audio signal and the at least one additional audio signal based on the relative position between the first position and the second position such that the at least two output audio channel signals present an augmented audio scene.

Generating the at least two output audio channel signals may comprise mixing and processing the spatial audio signal and the at least one additional audio signal such that a perception of a source of the spatial audio signal and the at least one additional microphone signal is enhanced.

Generating the at least two output audio channel signals may comprise mixing and processing the spatial audio signal and the at least one additional audio signal such that a spatial positioning of a source of the spatial audio signal and the at least one additional microphone signal as perceived by a listener is changed.

Generating the at least two output audio channel signals may comprise combining the spatial audio signal and the at least one additional audio signal in a ratio defined by a distance defined by the relative position between the first position associated with the microphone array and the second position associated with the additional microphone.

The method may further comprise receiving a user input defining an orientation of a listener, and generating the at least two output audio channel signals by processing and mixing further comprises generating the at least two output audio channel signals by processing and mixing the spatial audio signal and at least one additional audio signal based further on the user input.

Generating the at least two output audio channel signals may comprise generating at least one binaural rendering of the at least one additional audio signal by: determining a head related transfer function based on the relative position; applying the head related transfer function to the at least one additional audio signal to generate a first pair of binaural audio signals; applying a plurality of fixed further head related transfer functions to a decorrelated additional audio signal to generate further pairs of binaural audio signals; and combining the first and further pairs of binaural audio signals to generate the at least one binaural rendering of the at least one additional audio signal.

Applying the head related transfer function to the at least one additional audio signal to generate a first pair of binaural audio signals may further comprise applying a direct gain to the at least one additional audio signal before applying the head related transfer function, and applying a plurality of fixed further head related transfer functions may further comprise applying a wet gain to the at least one additional audio signal before applying the plurality of the fixed further head related transfer functions.

The method may further comprise determining a ratio of the direct gain to the wet gain based on the distance between the first position and the second position.

Generating the at least two output audio channel signals may further comprise generating at least one binaural rendering of the spatial audio signal by: determining a head related transfer function based on a spatial audio signal channel orientation; applying the head related transfer function to a spatial audio signal associated with the channel orientation to generate a first pair of binaural spatial audio signals; applying a plurality of fixed further head related transfer functions to a decorrelated spatial audio signal associated with the spatial audio signal channel orientation to generate further pairs of binaural spatial audio signals; and combining the first and further pairs of binaural spatial audio signals to generate the at least one binaural rendering of the spatial audio signal.

Generating the at least two output audio channel signals may further comprise generating a binaural rendering for each channel of the spatial audio signal.

Generating the at least two output audio channel signals may further comprise combining the at least one binaural rendering of the spatial audio signal and the at least one binaural rendering of the at least one additional audio signal.

According to a third aspect there is provided a method comprising: determining a spatial audio signal captured by a microphone array at a first position configured to provide spatial audio capture; determining at least one additional audio signal captured by an additional microphone at a second position; determining and tracking a relative position between the first position and the second position; determining a variable delay between the spatial audio signal and at least one additional audio signal such that the audio signals are time aligned; and applying the variable delay to the at least one additional audio signal to substantially align the spatial audio signal and the at least one additional audio signal.

The method may further comprise outputting or storing: the spatial audio signal; the at least one additional audio signal delayed by the variable delay; and the relative position between the first position and the second position.

The method may further comprise: associating the microphone array with a first position tag identifying the first position; and associating the at least one additional microphone with a second position tag identifying the second position, wherein determining and tracking a relative position may comprise determining the relative position by comparing the first position tag and the second position tag.

Determining the variable delay may comprise: determining a maximum correlation value between the spatial audio signal and the at least one additional audio signal; and determining the variable delay as a time value associated with the maximum correlation value.

The method may further comprise performing a correlation on the spatial audio signal and the at least one additional audio signal over a range of time values centred at a time value based on a time required for sound to travel over a distance between the first position and the second position.

Determining and tracking a relative position between the first position and the second position may comprise: determining the first position defining the position of the microphone array; determining the second position defining the position of the at least one additional microphone; determining a relative distance between the first position and the second position; and determining at least one orientation difference between the first position and the second position.

A method may comprise: the capture method as described herein; and the rendering method as described herein.

A computer program product stored on a medium for causing an apparatus to perform the method as described herein.

According to a fifth aspect there is provided an apparatus comprising: means for receiving a spatial audio signal associated with a microphone array configured to provide spatial audio capture and at least one additional audio signal associated with an additional microphone, the at least one additional microphone signal having been delayed by a variable delay determined such that the spatial audio signal and the at least one additional microphone signal are time aligned; means for receiving a relative position between a first position associated with the microphone array and a second position associated with the additional microphone; means for generating at least two output audio channel signals by processing and mixing the spatial audio signal and the at least one additional audio signal based on the relative position between the first position and the second position such that the at least two output audio channel signals present an augmented audio scene.

The means for generating the at least two output audio channel signals may comprise means for mixing and processing the spatial audio signal and the at least one additional audio signal such that a perception of a source of the spatial audio signal and the at least one additional microphone signal is enhanced.

The means for generating the at least two output audio channel signals may comprise mixing and processing the spatial audio signal and the at least one additional audio signal such that a spatial positioning of a source captured by the spatial audio signal and the at least one additional microphone signal as perceived by a listener is changed.

The means for generating the at least two output audio channel signals may comprise combining the spatial audio signal and the at least one additional audio signal in a ratio defined by a distance defined by the relative position between the first position associated with the microphone array and the second position associated with the additional microphone.

The apparatus may further comprise means for receiving a user input defining an orientation of a listener, and the means for generating the at least two output audio channel signals by processing and mixing further comprises means for generating the at least two output audio channel signals by processing and mixing the spatial audio signal and at least one additional audio signal based further on the user input.

The means for generating the at least two output audio channel signals may comprise means for generating at least one binaural rendering of the at least one additional audio signal comprising: means for determining a head related transfer function based on the relative position; means for applying the head related transfer function to the at least one additional audio signal to generate a first pair of binaural audio signals; means for applying a plurality of fixed further head related transfer functions to a decorrelated additional audio signal to generate further pairs of binaural audio signals; and means for combining the first and further pairs of binaural audio signals to generate the at least one binaural rendering of the at least one additional audio signal.

The means for applying the head related transfer function to the at least one additional audio signal to generate a first pair of binaural audio signals may further comprise means for applying a direct gain to the at least one additional audio signal before applying the head related transfer function, and the means for applying a plurality of fixed further head related transfer functions may further comprise means for applying a wet gain to the at least one additional audio signal before applying the plurality of the fixed further head related transfer functions.

The apparatus may further comprise means for determining a ratio of the direct gain to the wet gain based on the distance between the first position and the second position.

The means for generating the at least two output audio channel signals may further comprise means for generating at least one binaural rendering of the spatial audio signal, which may comprise: means for determining a head related transfer function based on a spatial audio signal channel orientation; means for applying the head related transfer function to a spatial audio signal associated with the channel orientation to generate a first pair of binaural spatial audio signals; means for applying a plurality of fixed further head related transfer functions to a decorrelated spatial audio signal associated with the spatial audio signal channel orientation to generate further pairs of binaural spatial audio signals; and means for combining the first and further pairs of binaural spatial audio signals to generate the at least one binaural rendering of the spatial audio signal.

The means for generating the at least two output audio channel signals may further comprise means for generating a binaural rendering for each channel of the spatial audio signal.

The means for generating the at least two output audio channel signals may further comprise combining the at least one binaural rendering of the spatial audio signal and the at least one binaural rendering of the at least one additional audio signal.

According to a fifth aspect there is provided an apparatus comprising: means for determining a spatial audio signal captured by a microphone array at a first position configured to provide spatial audio capture; means for determining at least one additional audio signal captured by an additional microphone at a second position; means for determining and tracking a relative position between the first position and the second position; means for determining a variable delay between the spatial audio signal and at least one additional audio signal such that the audio signals are time aligned; and means for applying the variable delay to the at least one additional audio signal to substantially align the spatial audio signal and the at least one additional audio signal.

The apparatus may further comprise means for outputting or storing at least one of: the spatial audio signal; the at least one additional audio signal delayed by the variable delay; and the relative position between the first position and the second position.

The apparatus may further comprise: means for associating the microphone array with a first position tag identifying the first position; and associating the at least one additional microphone with a second position tag identifying the second position, wherein the means for determining and tracking a relative position may comprise means for determining the relative position by comparing the first position tag and the second position tag.

The means for determining the variable delay may comprise: means for determining a maximum correlation value between the spatial audio signal and the at least one additional audio signal; and means for determining the variable delay as a time value associated with the maximum correlation value.

The apparatus may further comprise means for performing a correlation on the spatial audio signal and the at least one additional audio signal over a range of time values centred at a time value based on a time required for sound to travel over a distance between the first position and the second position.

The means for determining and tracking a relative position between the first position and the second position may comprise: means for determining the first position defining the position of the microphone array; means for determining the second position defining the position of the at least one additional microphone; means for determining a relative distance between the first position and the second position; and means for determining at least one orientation difference between the first position and the second position.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

Figure 1:
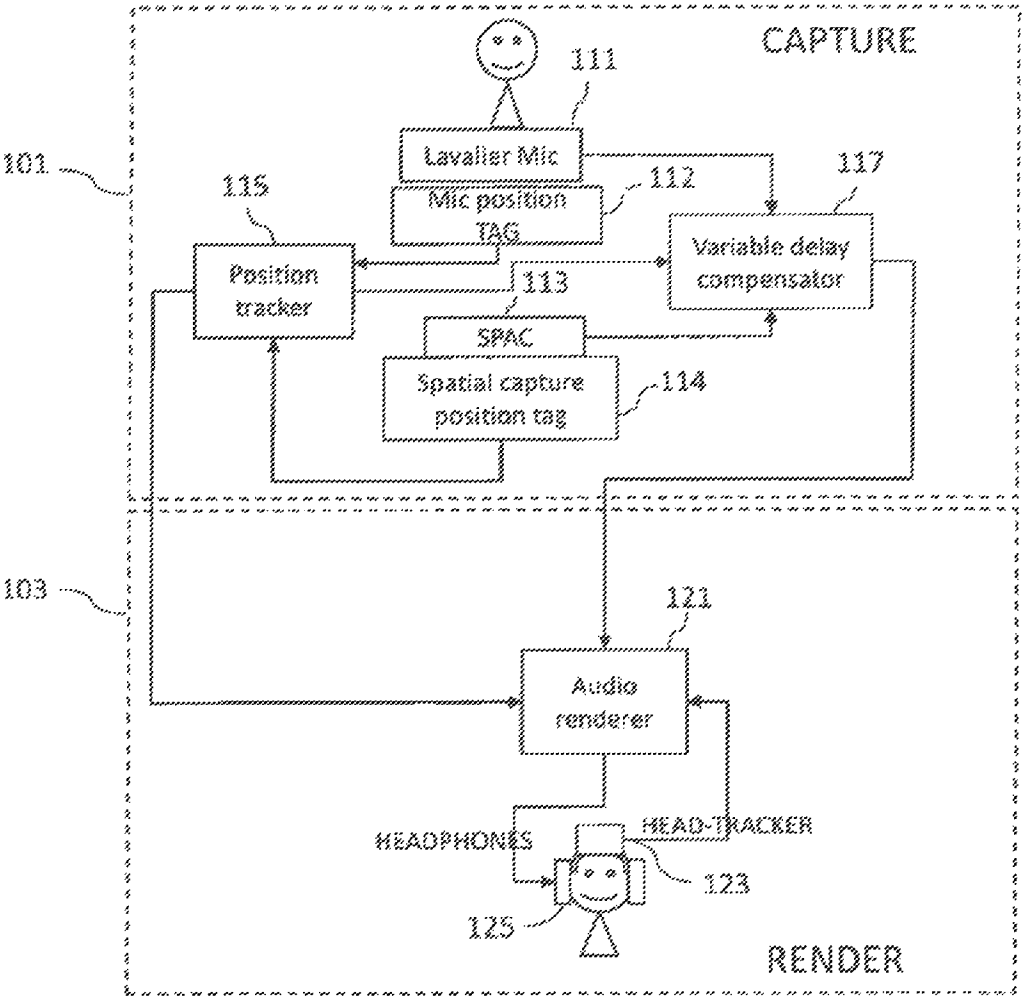
FIG. 1 shows schematically capture and render apparatus suitable for implementing spatial audio capture and rendering according to some embodiments.

The following describes in further detail suitable apparatus and possible mechanisms for the provision of effective capture of audio signals from multiple sources and mixing of those audio signals when these sources are moving in the spatial field. In the following examples, audio signals and audio capture signals are described. However it would be appreciated that in some embodiments the apparatus may be part of any suitable electronic device or apparatus configured to capture an audio signal or receive the audio signals and other information signals.

As described previously a conventional approach to the capturing and mixing of audio sources with respect to an audio background or environment audio field signal would be for a professional producer to utilize a close microphone (a Lavalier microphone worn by the user or a microphone attached to a boom pole) to capture audio signals close to the audio source, and further utilize a 'background' microphone to capture a environmental audio signal. These signals or audio tracks may then be manually mixed to produce an output audio signal such that the produced sound features the audio source coming from an intended (though not necessarily the original) direction.

As would be expected this requires significant time and effort and expertise to do correctly. Furthermore such professionally produced mixes are not flexible and cannot easily be modified by the end user. For example moving the close microphone audio signal within the environment is not typically possible by the listener without significant effort.

The concept as described herein may be considered to be enhancement to conventional Spatial Audio Capture (SPAC) technology. Spatial audio capture technology can process audio signals captured via a microphone array into a spatial audio format. In other words generating an audio signal format with a spatial perception capacity. The concept may thus be embodied in a form where audio signals may be captured such that, when rendered to a user, the user can experience the sound field as if they were present at the location of the capture device. Spatial audio capture can be implemented for microphone arrays found in mobile devices. In addition, audio processing derived from the spatial audio capture may be used employed within a presence-capturing device such as the Nokia OZO (OZO) devices.

In the examples described herein the audio signal is rendered into a suitable binaural form, where the spatial sensation may be created using rendering such as by head-related-transfer-function (HRTF) filtering a suitable audio signal.

The concept as described with respect to the embodiments herein makes it possible to capture and remix a close and environment audio signal more effectively and efficiently.

The concept may for example be embodied as a capture system configured to capture both a close (speaker, instrument or other source) audio signal and a spatial (audio field) audio signal. The capture system may furthermore be configured to determine a location of the source relative to the spatial capture components and further determine the audio signal delay required to synchronize the close audio signal to the spatial audio signal. This information may then be stored or passed to a suitable rendering system which having received the audio signals and the information (positional and delay time) may use this information to generate a suitable mixing and rendering of the audio signal to a user. Furthermore in some embodiments the render system may enable the user to input a suitable input to control the mixing, for example by use of a headtracking or other input which causes the mixing to be changed.

The concept furthermore is embodied by the ability to track locations of the Lavalier microphones generating the close audio signals using high-accuracy indoor positioning or another suitable technique. The position or location data (azimuth, elevation, distance) can then be associated with the spatial audio signal captured by the microphones. The close audio signal captured by the Lavalier microphones may be furthermore time-aligned with the spatial audio signal, and made available for rendering. For reproduction with static loudspeaker setups such as 5.1., a static downmix can be done using amplitude panning techniques. For reproduction using binaural techniques, the time-aligned Lavalier microphone signals can be stored or communicated together with time-varying spatial position data and the spatial audio track. For example, the audio signals could be encoded, stored, and transmitted in a Moving Picture Experts Group (MPEG) MPEG-H 3D audio format, specified as ISO/IEC 23008-3 (MPEG-H Part 3), where ISO stands for International Organization for Standardization and IEC stands for International Electrotechnical Commission.

It is believed that the main benefits of the invention include flexible capturing of spatial audio and separate close-up audio tracks, which makes it possible to increase gain or otherwise separately process, enhance, or spatially reposition the most important sources during or before rendering. An example includes increasing speech intelligibility in noisy capture situations, in reverberant environments, or in capture situations with multiple direct and ambient sources.

Although the capture and render systems are shown as being separate, it is understood that they may be implemented with the same apparatus or may be distributed over a series of physically separate but communication capable apparatus. For example, an a presence-capturing device such as the OZO device could be equipped with an additional interface for receiving location data and Lavalier microphone sources, and could be configured to perform the capture part. The output of the capture part would be the spatial audio (e.g. as a 5.1 channel downmix), the Lavalier sources which are time-delay compensated to match the time of the spatial audio, and the source location of the Lavalier sources (time-varying azimuth, elevation, distance with regard to the spatial capture device).

In some embodiments the raw spatial audio captured by the array microphones (instead of spatial audio processed into 5.1) may be transmitted to the renderer, and the renderer perform spatial processing such as described herein.

The renderer as described herein may be a set of headphones with a motion tracker, and software capable of binaural audio rendering. With head tracking, the spatial audio can be rendered in a fixed orientation with regards to the earth, instead of rotating along with the person's head.

Furthermore it is understood that at least some elements of the following capture and render apparatus may be implemented within a distributed computing system such as known as the 'cloud'.

With respect to FIG. 1 is shown a system comprising capture 101 and render 103 apparatus suitable for implementing spatial audio capture and rendering according to some embodiments. In the following examples there is shown only one close audio signal, however more than one close audio signal may be captured and the following apparatus and methods applied to the further close audio signals. For example in some embodiments one or more persons may be equipped with microphones to generate a close audio signal for each person (of which only one is described herein).

For example the capture apparatus 101 comprises a Lavalier microphone 111. The Lavalier microphone is an example of a 'close' audio source capture apparatus and may in some embodiments be a boom microphone or similar neighbouring microphone capture system. Although the following examples are described with respect to a Lavalier microphone and thus a Lavalier audio signal the concept may be extended to any microphone external or separate to the microphones or array of microphones configured to capture the spatial audio signal. Thus the concept is applicable to any external/additional microphones in addition to the SPAC microphone array, be they Lavalier microphones, hand held microphones, mounted mics, or whatever. The external microphones can be worn/carried by persons or mounted as close-up microphones for instruments or a microphone in some relevant location which the designer wishes to capture accurately. The Lavalier microphone 111 may in some embodiments be a microphone array. The Lavalier microphone typically comprises a small microphone worn around the ear or otherwise close to the mouth. For other sound sources, such as musical instruments, the audio signal may be provided either by a Lavalier microphone or by an internal microphone system of the instrument (e.g., pick-up microphones in the case of an electric guitar).

The Lavalier microphone 111 may be configured to output the captured audio signals to a variable delay compensator 117. The Lavalier microphone may be connected to a transmitter unit (not shown), which wirelessly transmits the audio signal to a receiver unit (not shown).

Furthermore the capture apparatus 101 comprises a Lavalier (or close source) microphone position tag 112. The Lavalier microphone position tag 112 may be configured to determine information identifying the position or location of the Lavalier microphone 111 or other close microphone. It is important to note that microphones worn by people can be freely move in the acoustic space and the system supporting location sensing of wearable microphone has to support continuous sensing of user or microphone location. The Lavalier microphone position tag 112 may be configured to output this determination of the position of the Lavalier microphone to a position tracker 115.

The capture apparatus 101 comprises a spatial audio capture (SPAC) device 113. The spatial audio capture device is an example of an 'audio field' capture apparatus and may in some embodiments be a directional or omnidirectional microphone array. The spatial audio capture device 113 may be configured to output the captured audio signals to a variable delay compensator 117.

Furthermore the capture apparatus 101 comprises a spatial capture position tag 114. The spatial capture position tag 114 may be configured to determine information identifying the position or location of the spatial audio capture device 113. The spatial capture position tag 114 may be configured to output this determination of the position of the spatial capture microphone to a position tracker 115. In the case the position tracker is co-located with the capture apparatus or the position of the capture apparatus with respect to the position tracker is otherwise known, and location data is obtained in relation to the capture apparatus, the capture apparatus does not need to comprise a position tag.

In some embodiments the spatial audio capture device 113 is implemented within a mobile device. The spatial audio capture device is thus configured to capture spatial audio, which, when rendered to a listener, enables the listener to experience the sound field as if they were present in the location of the spatial audio capture device. The Lavalier microphone in such embodiments is configured to capture high quality close-up audio signals (for example from a key person's voice, or a musical instrument). When mixed to the spatial audio field, the attributes of the key source such as gain, timbre and spatial position may be adjusted in order to provide the listener with a much more realistic immersive experience. In addition, it is possible to produce more point-like auditory objects, thus increasing the engagement and intelligibility.

The capture apparatus 101 furthermore may comprise a position tracker 115. The position tracker 115 may be configured to receive the positional tag information identifying positions of the Lavalier microphone 111 and the spatial audio capture device 113 and generate a suitable output identifying the relative position of the Lavalier microphone 111 relative to the spatial audio capture device 113 and output this to the render apparatus 103 and specifically in this example an audio renderer 121. Furthermore in some embodiments the position tracker 115 may be configured to output the tracked position information to a variable delay compensator 117.

Thus in some embodiments the locations of the Lavalier microphones (or the persons carrying them) with respect to the spatial audio capture device can be tracked and used for mixing the sources to correct spatial positions. In some embodiments the position tags, the microphone position tag 112 and the spatial capture position tag 114 are implemented using High Accuracy Indoor Positioning (HAIP) or another suitable indoor positioning technology. In some embodiments, in addition to or instead of HAIP, the position tracker may use video content analysis and/or sound source localization.

The capture apparatus 101 furthermore may comprise a variable delay compensator 117 configured to receive the outputs of the Lavalier microphone 111 and the spatial audio capture device 113. Furthermore in some embodiments the variable delay compensator 117 may be configured to receive source position and tracking information from the position tracker 115. The variable delay compensator 117 may be configured to determine any timing mismatch or lack of synchronisation between the close audio source signals and the spatial capture audio signals and determine the timing delay which would be required to restore synchronisation between the signals. In some embodiments the variable delay compensator 117 may be configured to apply the delay to one of the signals before outputting the signals to the render apparatus 103 and specifically in this example to the audio renderer 121. The timing delay may be referred as being a positive time delay or a negative time delay with respect to an audio signal. For example, denote a first (spatial) audio signal by x, and another (Lavalier) audio signal by y. The variable delay compensator 117 is configured to try to find a delay $\tau$, such that $x(n)=y(n-\tau)$. Here, the delay $\tau$ can be either positive or negative.

In some embodiments the render apparatus 103 comprises a head tracker 123. The head tracker 123 may be any suitable means for generating a positional input, for example a sensor attached to a set of headphones configured to monitor the orientation of the listener, with respect to a defined or reference orientation and provide a value or input which can be used by the audio renderer 121. The head tracker 123 may in some embodiments be implemented by at least one gyroscope and/or digital compass.

The render apparatus 103 comprises an audio renderer 121. The audio renderer 121 is configured to receive the audio signals from the capture apparatus 101 and furthermore the positional information from the capture apparatus 101. The audio renderer 121 can furthermore be configured to receive an input from the head tracker 123. Furthermore the audio renderer 121 can be configured to receive other user inputs. The audio renderer 121, as described herein in further detail later, can be configured to mix together the audio signals, the Lavalier microphone audio signals and the spatial audio signals based on the positional information and the head tracker inputs in order to generate a mixed audio signal. The mixed audio signal can for example be passed to headphones 125. However the output mixed audio signal can be passed to any other suitable audio system for playback (for example a 5.1 channel audio amplifier).

In some embodiments the audio renderer 121 may be configured to perform spatial audio processing on the audio signals from the microphone array and from the close microphone.

The Lavalier audio signal from the Lavalier microphone and the spatial audio captured by the microphone array and processed with the spatial analysis may in some embodiments be combined by the audio renderer to a single binaural output which can be listened through headphones.

In the following examples the spatial audio signal is converted into a multichannel signal. The multichannel output may then be binaurally rendered, and summed with binaurally rendered Lavalier source signals.

The rendering may be described initially with respect to a single (mono) channel, which can be one of the multichannel signals from the spatial audio signal or one of the Lavalier sources. Each channel in the multichannel signal set may be processed in a similar manner, with the treatment for Lavalier audio signals and multichannel signals having the following differences:

1) The Lavalier audio signals have time-varying location data (direction of arrival and distance) whereas the multichannel signals are rendered from a fixed location.

2) The ratio between synthesized "direct" and "ambient" components may be used to control the distance perception for Lavalier sources, whereas the multichannel signals are rendered with a fixed ratio.

3) The gain of Lavalier signals may be adjusted by the user whereas the gain for multichannel signals is kept constant.

The render apparatus 103 in some embodiments comprises headphones 125. The headphones can be used by the listener to generate the audio experience using the output from the audio renderer 121.

Thus based on the location tracking, the Lavalier microphone signals can be mixed to suitable spatial positions in the spatial audio field. The rendering can be done by rendering the spatial audio signal using virtual loudspeakers with fixed positions, and the captured Lavalier source is rendered from a time varying position. Thus, the audio renderer 121 is configured to control the azimuth, elevation, and distance of the Lavalier or close source based on the tracked position data.

Moreover, the user may be allowed to adjust the gain and/or spatial position of the Lavalier source using the output from the head-tracker 123. For example by moving the listeners head the head-tracker input may affect the mix of the Lavalier source relative to the spatial sound. This may be by changing the 'spatial position' of the Lavalier source based on the head-tracker or by changing the gain of the Lavalier source where the head-tracker input is indicating that the listener's head is 'towards' or 'focussing' on a specific source. Thus the mixing/rendering may be dependent on the relative position/orientation of the Lavalier source and the spatial microphones but also be dependent on the orientation of the head as measured by the head-tracker. In some embodiments the user input may be any suitable user interface input, such as an input from a touchscreen indicating the listening direction or orientation.

Alternatively to a binaural rendering (for headphones), a spatial downmix into a 5.1 channel format or other format could be employed. In this case, the Lavalier or close source can in some embodiments mixed to its 'proper' spatial position using known amplitude panning techniques.

Figure 2:
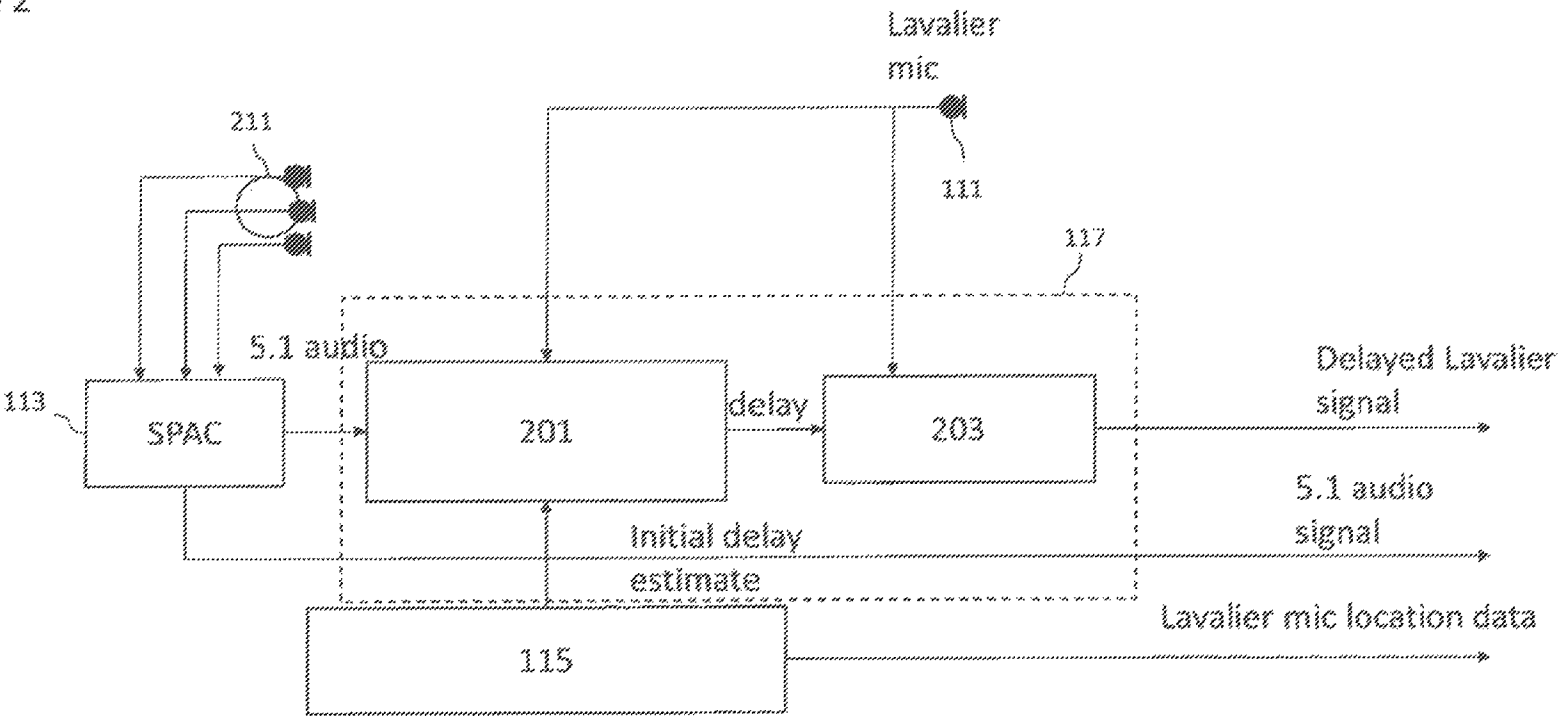
FIG. 2 shows schematically a variable delay compensator as shown in FIG. 1 according to some embodiments.

With respect to FIG. 2, the variable delay compensator 117 is shown in further detail. FIG. 2 for example shows the spatial audio capture microphone array 211 which is configured to output captured audio signals to a spatial audio capture (SPAC) device 113.

The SPAC is configured to generate a suitable spatial encoded audio signal from the spatial audio capture microphone array 211 audio signals. The SPAC 113 is shown generating, in the example shown in FIG. 2, a 5.1 channel format audio signal. In some embodiments the spatial encoded audio signal is output and passes through the variable delay compensator 117 to be output to the renderer 103. Furthermore the SPAC is shown outputting at least part of the spatial encoded audio signal to the variable delay compensator 117.

The variable delay compensator 117 in some embodiments comprises a time delay estimator 201. The time delay estimator may be configured to receive at least part of the spatial encoded audio signal (for example the central channel of the 5.1 channel format spatial encoded channel). Furthermore the variable delay compensator 117 and the time delay estimator 201 is configured to receive an output from the Lavalier microphone 111. Furthermore in some embodiments the variable delay compensator 117, and specifically the time delay estimator can be configured to receive an input from the position tracker 115.

Since the Lavalier or close microphone may change its location (for example because the person wearing the microphone moves while speaking), the capture apparatus 101 can be configured to track the location or position of the close microphone (relative to the spatial audio capture device) over time. Furthermore, the time-varying location of the close microphone relative to the spatial capture device causes a time-varying delay between the audio signal from the Lavalier microphone and the audio signal generated by the SPAC. The variable delay compensator 117 is configured to apply a delay to one of the signals in order to compensate for the temporal difference, so that the timing of the audio signals of the audio source captured by the spatial audio capture device and the Lavalier microphone are equal (assuming the Lavalier source is audible when captured by the spatial audio capture device). If the Lavalier microphone source is not audible or hardly audible in the spatial audio capture device, the delay compensation may be done approximately based on the position (or HAIP location) data.

Thus in some embodiments the time delay estimator 201 can estimate the delay of the close source between the Lavalier microphone and spatial audio capture device.

The time-delay can in some embodiments be implemented by cross correlating the Lavalier microphone signal to the spatial audio capture signal. For example the centre channel of the 5.1 format spatial audio capture audio signal may be correlated against the Lavalier microphone audio signal. Moreover, since the delay is time-varying, the correlation is performed over time. For example short temporal frames, for example of 4096 samples, can be correlated.

In such an embodiment a frame of the spatial audio centre channel at time n, denoted as a(n), is zero padded to twice its length. Furthermore, a frame of the Lavalier microphone captured signal at time n, denoted as b(n), is also zero padded to twice its length. The cross correlation can be calculated as $$corr(a(n),b(n))=ifft(fft(a(n))*conj(fft(b(n))))$$

where fft stands for the Fast Fourier Transform (FFT), ifft for its inverse, and conj denotes the complex conjugate.

A peak in the correlation value can be used to indicate a delay where the signals are most correlated, and this can be passed to a variable delay line 203 to set the variable delay line with the amount with which the Lavalier microphone needs to be delayed (or offset in more general terms) in order to match the spatial audio captured audio signals.

In some embodiments various weighting strategies can be applied to emphasize the frequencies that are the most relevant for the signal delay estimation for the desired sound source of interest.

In some embodiments a position or location difference estimate from the position tracker 115 can be used as the initial delay estimate. More specifically, if the distance of the Lavalier source from the spatial audio capture device is d, then an initial delay estimate can be calculated as $$D_{initial} = \frac{dF_s}{v}$$

where $F_s$ is the sampling rate of signal and v is the speed of the sound in the air.

The frame where the correlation is calculated can thus be positioned such that its centre corresponds with the initial delay value.

In some embodiments the variable delay compensator 117 comprises a variable delay line 203. The variable delay line 203 may be configured to receive the audio signal from the Lavalier microphone 111 and delay the audio signal by the delay value estimated by the time delay estimator 201. In other words when the 'optimal' delay is known, the signal captured by the Lavalier microphone is delayed by the corresponding amount.

The delayed Lavalier microphone 111 audio signals may then be output to be stored or processed as discussed herein.

Figure 3A:
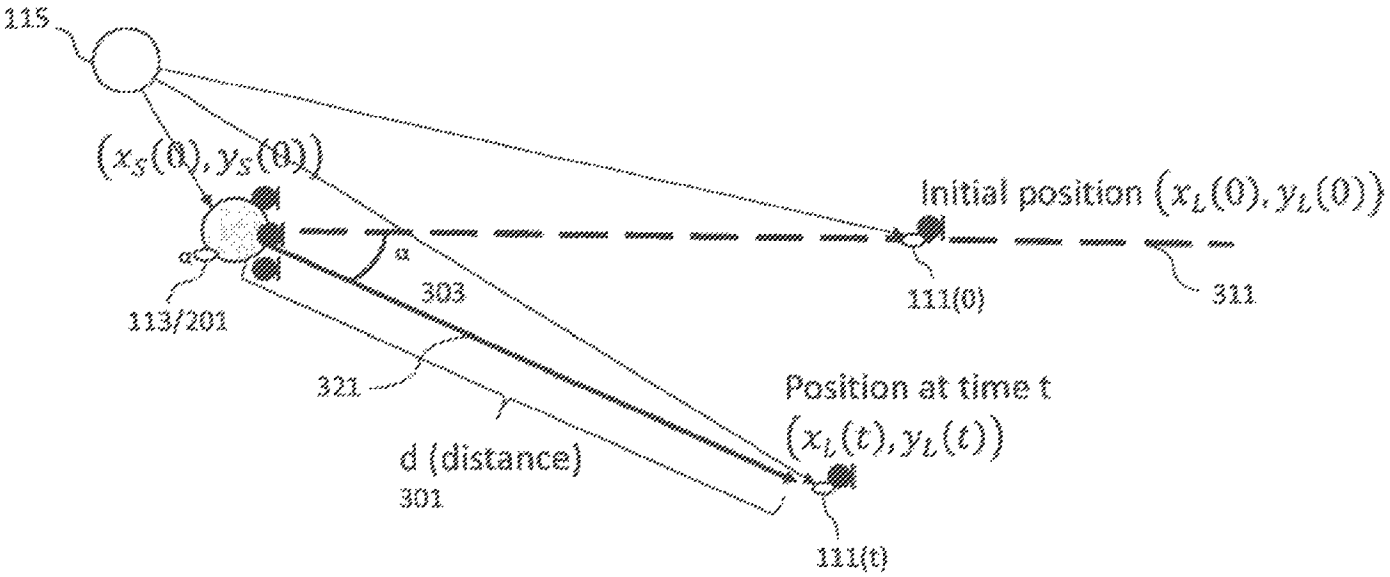
FIGS. 3*a* and 3*b* show schematically example positions for a mobile source relative to a spatial capture apparatus which may be analysed by the position tracker as shown in FIG. 1 according to some embodiments.
Figure 3B:
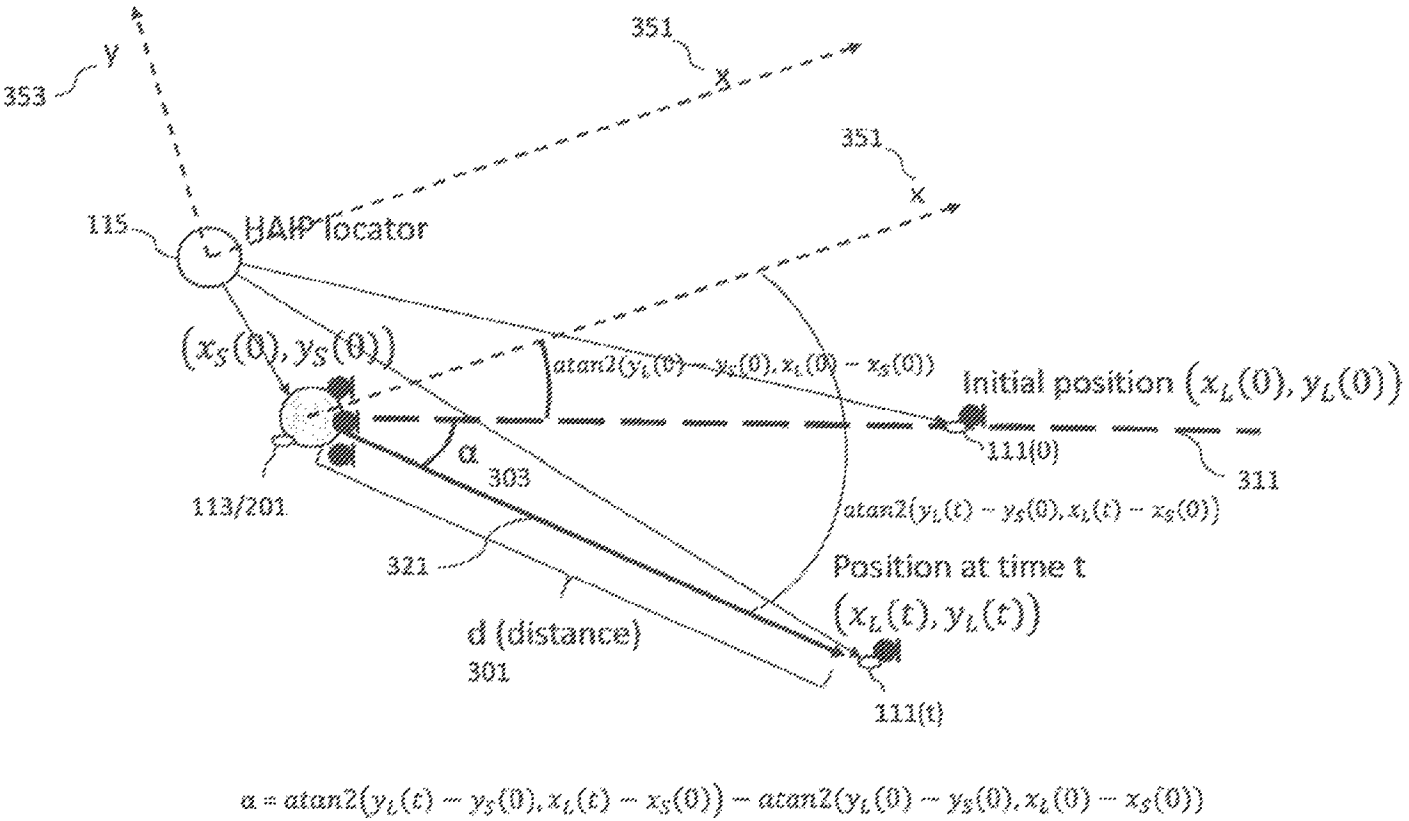
Figure 4:
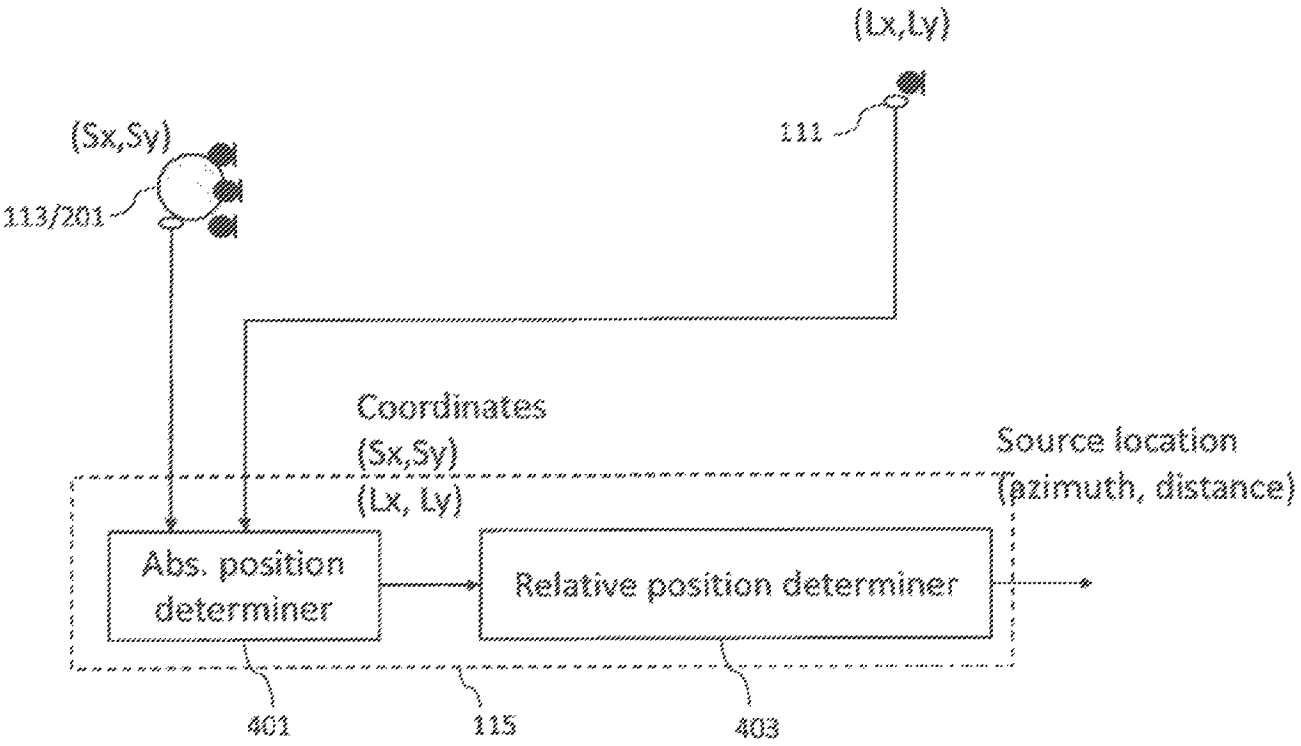
FIG. 4 shows an example position tracker as shown in FIG. 1 according to some embodiments.

With respect to FIGS. 3*a*, 3*b* and 4 are shown the positional or location apparatus, such as the position tracker 115 shown in FIG. 1 and how the position or location tracking may be implemented in some embodiments.

For example FIGS. 3*a* and 3*b* show example positions of the SPAC microphone 211 (or SPAC device 113) and the Lavalier microphone 111 at an initial position 111(0) and at a position after a time t 111(*t*).

In the following example position tracking is implemented using HAIP tags. As shown in FIG. 1, both the Lavalier microphone 111 and the spatial capture device 113 are equipped with HAIP tags (112 and 114 respectively), and then a position tracker 115, which may be a HAIP locator, is configured to track the location of both tags.

In some other implementations, the HAIP locator may be positioned close or attached to the spatial audio capture device and the tracker 115 coordinate system aligned with the spatial audio capture device 113. In such embodiments the position tracker 115 would track just the Lavalier microphone position.

With respect to FIG. 4, the position tracker 115 is shown schematically in further detail. In some embodiments the position tracker comprises absolute position determiner 401. The absolute position determiner 401 is configured to receive the HAIP locator tags and generate the absolute position information from the tag information.

In some other embodiments, the position information might be partial, comprising only, for example, direction-of-arrival (DOA) information. In this case, the distance information might be predefined or determined using some other means, for example using visual analysis.

The absolute position determiner 401 may then output this information to the relative position determiner 403.

The position tracker 115 in some embodiments comprises a relative position determiner configured to receive the absolute positions of the SPAC device and the Lavalier microphones and determine and track the relative position of each. This relative position may then be output to the render apparatus 103.

Thus in some embodiments the position or location of the spatial audio capture device is determined. The location of the spatial audio capture device may be denoted (at time 0) as $$(x_s(0), y_s(0))$$

In some embodiments there may be implemented a calibration phase or operation (in other words defining a 0 time instance) where the Lavalier microphone is positioned in front of the SPAC array at some distance within the range of a HAIP locator. This position of the Lavalier microphone may be denoted as $$(x_L(0), y_L(0))$$

Furthermore in some embodiments this calibration phase can determine the 'front-direction' of the spatial audio capture device in the HAIP coordinate system. This can be performed by firstly defining the array front direction by the vector denoted by the dashed line 311

$$(x_L(0)-x_s(0), y_L(0)-y_s(0))$$

This vector may enable the position tracker to determine an azimuth angle α 303 and the distance d 301 with respect to the array.

For example given a Lavalier microphone position at time t $$(x_L(t), y_L(t))$$

The direction relative to the array is defined by the vector denoted by the solid line 321

$$(x_L(t)-x_s(0), y_L(t)-y_s(0))$$

The azimuth α may then be determined as $$\alpha = a\tan 2(y_L(t)-y_s(0), x_L(t)-x_s(0)) - a\tan 2(y_L(0)-y_s(0), x_L(0)-x_s(0))$$

where a tan 2(y,x) is a "Four-Quadrant Inverse Tangent" which gives the angle between the positive x-axis 351 and the point (x,y). Thus, the first term gives the angle between the positive x-axis 351 (origin at $x_s(0)$ and $y_s(0)$) and the point ($x_L(t)$, $y_L(t)$) and the second term is the angle between the x-axis 351 and the initial position ($x_L(0)$, $y_L(0)$). The azimuth angle 303 may be obtained by subtracting the first angle from the second.

The distance d 301 can be obtained as $$\sqrt{(x_L(t)-x_s(0))^2+(y(t)-y_s(0))^2}$$

In some embodiments, since the HAIP location data may be noisy, the positions ($x_L(0)$, $y_L(0)$) and ($x_s(0)$, $y_s(0)$) may be obtained by recording the positions of the HAIP tags of the audio capture device and the Lavalier source over a time window of some seconds (for example 30 seconds) and then averaging the recorded positions to obtain the inputs used in the equations above.

In some embodiments the calibration phase may be initialized by the SPAC device (for example the mobile device) being configured to output a speech or other instruction to instruct the user(s) to stay in front of the array for the 30 second duration, and give a sound indication after the period has ended.

Although the examples shown above show the position tracker 115 generating position information in two dimensions it is understood that this may be generalized to three dimensions, where the position tracker may determine an elevation angle as well as an azimuth angle and distance.

In some embodiments other position tracking means can be used for locating and tracking the moving sources. Examples of other tracking means may include inertial sensors, radar, ultrasound sensing, Lidar or laser distance meters, and so on.

In some embodiments, visual analysis and/or audio source localization are used in addition to or instead of indoor positioning.

Visual analysis, for example, may be performed in order to localize and track pre-defined sound sources, such as persons and musical instruments. The visual analysis may be applied on panoramic video which is captured along with the spatial audio. This analysis may thus identify and track the position of persons carrying the Lavalier microphones based on visual identification of the person. The advantage of visual tracking is that it may be used even when the sound source is silent and therefore when it is difficult to rely on audio based tracking. The visual tracking can be based on executing or running detectors trained on suitable datasets (such as datasets of images containing pedestrians) for each panoramic video frame. In some other embodiments tracking techniques such as kalman filtering and particle filtering can be implemented to obtain the correct trajectory of persons through video frames. The location of the person with respect to the front direction of the panoramic video, coinciding with the front direction of the spatial audio capture device, can then be used as the direction of arrival for that source. In some embodiments, visual markers or detectors based on the appearance of the Lavalier microphones could be used to help or improve the accuracy of the visual tracking methods.

In some embodiments visual analysis can not only provide information about the 2D position of the sound source (i.e., coordinates within the panoramic video frame), but can also provide information about the distance, which is proportional to the size of the detected sound source, assuming that a "standard" size for that sound source class is known. For example, the distance of 'any' person can be estimated based on an average height. Alternatively, a more precise distance estimate can be achieved by assuming that the system knows the size of the specific sound source. For example the system may know or be trained with the height of each person who needs to be tracked.

In some embodiments the 3D or distance information may be achieved by using depth-sensing devices. For example a 'Kinect' system, a time of flight camera, stereo cameras, or camera arrays, can be used to generate images which may be analysed and from image disparity from multiple images a depth or 3D visual scene may be created.

Audio source position determination and tracking can in some embodiments be used to track the sources. The source direction can be estimated, for example, using a time difference of arrival (TDOA) method. The source position determination may in some embodiments be implemented using steered beamformers along with particle filter-based tracking algorithms.

In some embodiments audio self-localization can be used to track the sources.

There are technologies, in radio technologies and connectivity solutions, which can furthermore support high accuracy synchronization between devices which can simplify distance measurement by removing the time offset uncertainty in audio correlation analysis. These techniques have been proposed for future WiFi standardization for the multichannel audio playback systems.

In some embodiments, position estimates from indoor positioning, visual analysis, and audio source localization can be used together, for example, the estimates provided by each may be averaged to obtain improved position determination and tracking accuracy. Furthermore, in order to minimize the computational load of visual analysis (which typically consumes much more computing power than the analysis of audio or HAIP signals), visual analysis may be applied only on portions of the entire panoramic frame, which correspond to the spatial locations where the audio and/or HAIP analysis sub-systems have estimated the presence of sound sources.

Position estimation can, in some embodiments, combine information from multiple sources and combination of multiple estimates has the potential for providing the most accurate position information for the proposed systems. However, it is beneficial that the system can be configured to use a subset of position sensing technologies to produce position estimates even at lower resolution.

Figure 5:
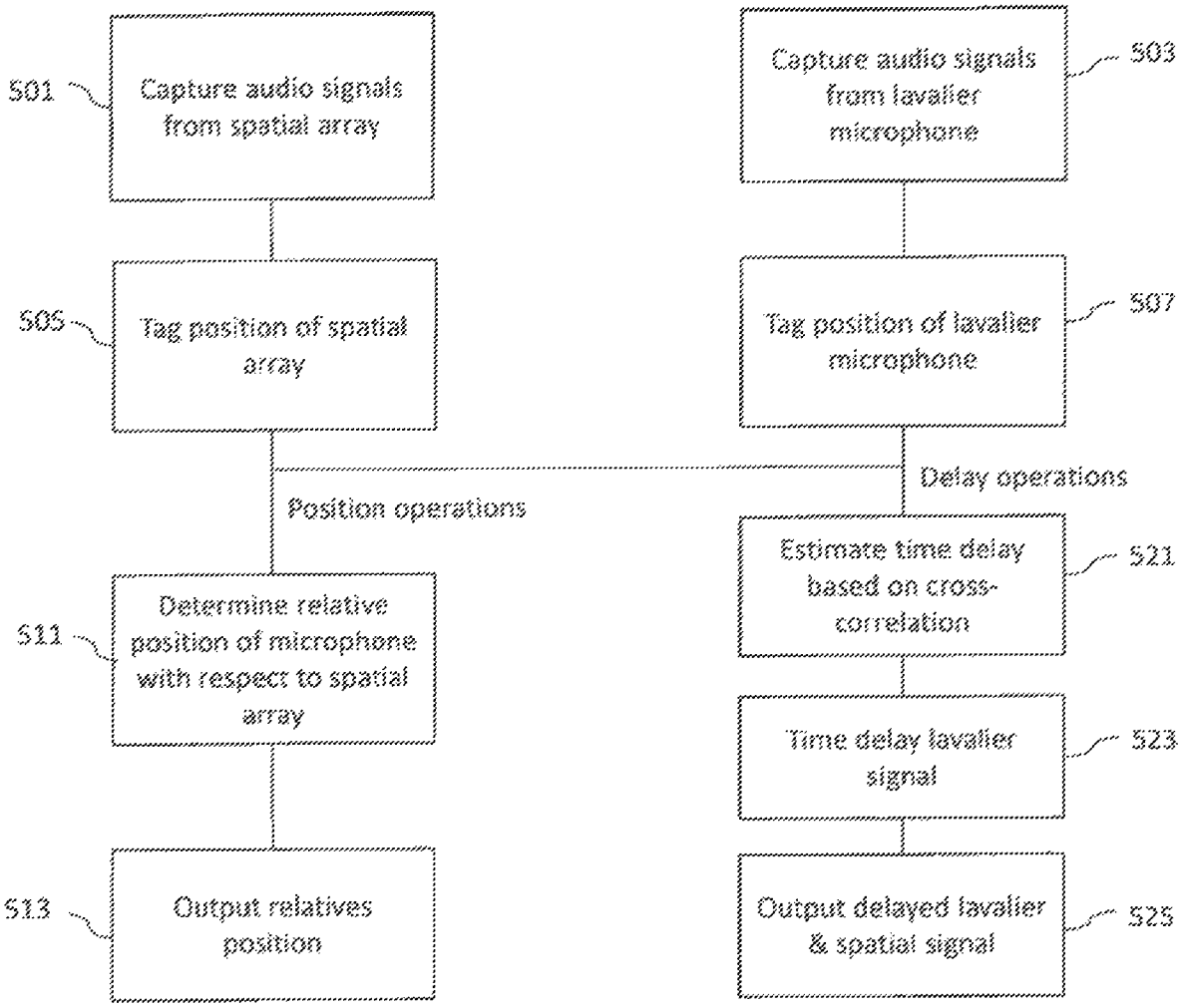
FIG. 5 shows a flow diagram of the operation of the example position tracker and variable delay compensator as shown in FIGS. 1, 2 and 4 according to some embodiments.

With respect to FIG. 5 a summary of the operations of the capture apparatus 101 is shown.

In some embodiments the capture apparatus is configured to capture audio signals from the spatial array of microphones.

The operation of capturing audio signals from the spatial array is shown in FIG. 5 by step 501.

Furthermore the capture apparatus is further configured to tag or determine the position of the spatial array.

The operation of tagging or determining the position of the spatial array is shown in FIG. 5 by step 505.

In some embodiments the capture apparatus is configured to capture audio signals from the Lavalier microphone.

The operation of capturing audio signals from the Lavalier microphone is shown in FIG. 5 by step 503.

Furthermore the capture apparatus is further configured to tag or determine the position of the Lavalier microphone.

The operation of tagging or determining the position of the Lavalier microphone is shown in FIG. 5 by step 507.

The capture apparatus may then using the tag or position information determine and track a relative position of the microphone with respect to the spatial array.

The operation of determining and tracking the relative position of the Lavalier or close microphone with respect to the spatial audio capture device or spatial array is shown in FIG. 5 by step 511.

The relative position of the Lavalier or close microphone relative to the spatial audio capture device or spatial array can then be output (to the render apparatus 103).

The operation of outputting the determined or tracked relative position is shown in FIG. 5 by step 513.

The capture apparatus may then generate an estimate of the time delay between the audio signals. This time delay may be based on a cross correlation determination between the signals.

The operation of generating an estimate of the time delay is shown in FIG. 5 by step 521.

The capture apparatus may apply the time delay to the Lavalier microphone audio signal.

The operation of applying the time delay to the Lavalier microphone audio signal is shown in FIG. 5 by step 523.

The capture apparatus may then output the time delayed Lavalier microphone audio signal and the spatial audio signal (to the render apparatus 103).

The operation of outputting time delayed Lavalier microphone audio signal and the spatial audio signal is shown in FIG. 5 by step 525.

Figure 6:
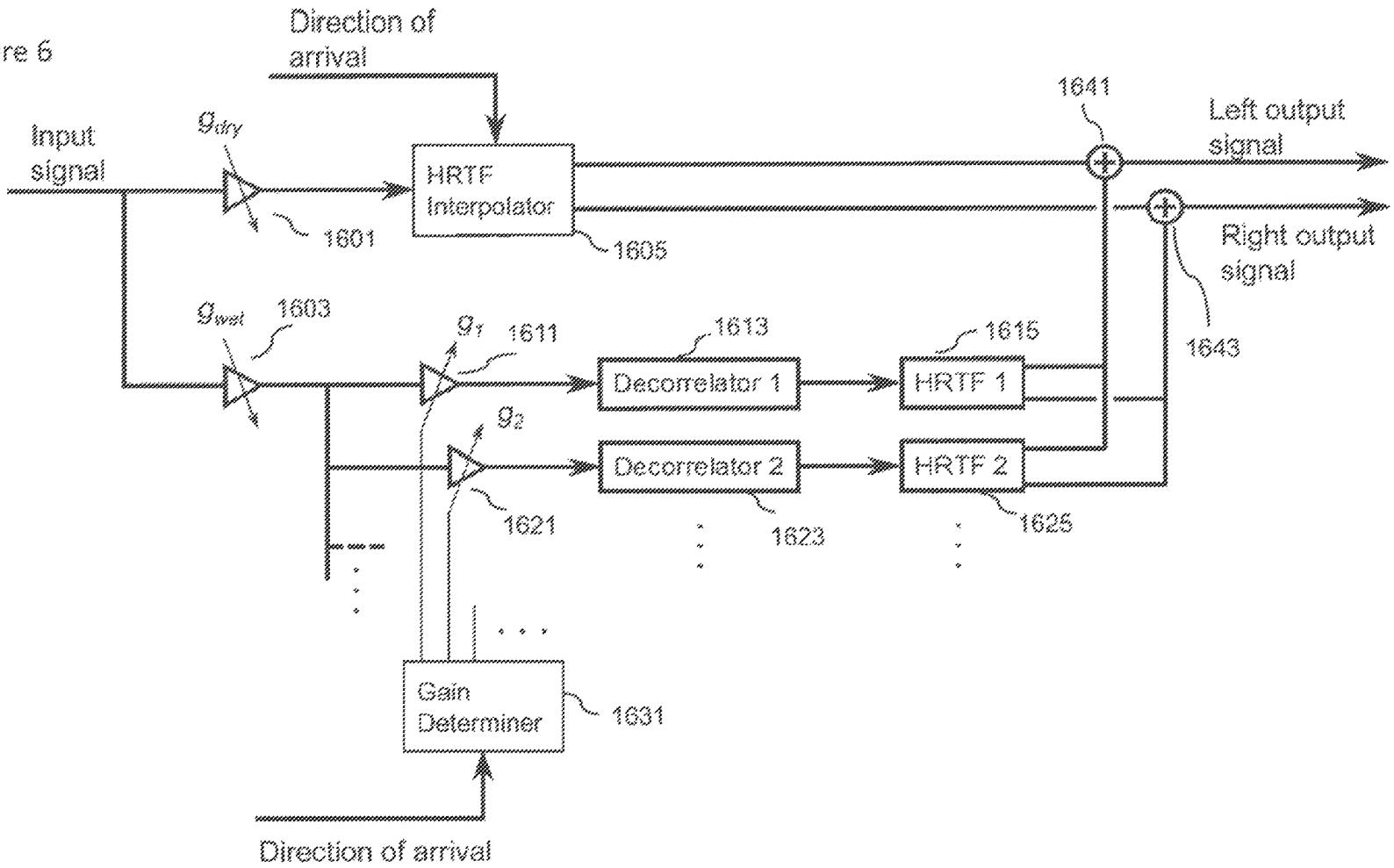
FIG. 6 shows an example rendering apparatus shown in FIG. 1 according to some embodiments.

With respect to FIG. 6 an example audio renderer 121 or render apparatus 103 is shown in further detail with respect to the an example rendering for a single mono channel, which can be one of the multichannel signals from the SPAC or one of the Lavalier sources.

The aim of the audio renderer is to be able to produce a perception of an auditory object in the desired direction and distance. The sound processed with this example is reproduced using headphones. In some embodiments a normal binaural rendering engine is employed together with a specific decorrelator. The binaural rendering engine produces the perception of direction. The decorrelator engine may comprise several static decorrelators convolved with static head-related transfer functions (HRTF) to produce the perception of distance. This may be achieved by causing fluctuation of inter-aural level differences (ILD), which have been found to be required for externalized binaural sound. When these two engines are mixed in a right proportion, the result is a perception of an externalized auditory object in a desired direction.

The examples shown herein employ static decorrelation engines. The input signal may be routed to each decorrelator after multiplication with a certain direction-dependent gain. The gain may be selected based on how close the relative direction of the auditory object is to the direction of the static decorrelator. As a result, interpolation artifacts, when rotating the head, may be avoided while still having directionality for the decorrelated content, which has been found to improve the quality of the output.

The audio renderer shown in FIG. 6 shows a mono audio signal input and a relative direction of arrival input. In some embodiments the relative direction is determined based on a determined desired direction in the world coordinate system (based on the relative direction between the spatial capture array and the Lavalier microphone) and an orientation of the head (based on the headtracker input).

The upper path of FIG. 6 shows a conventional binaural rendering engine. The input signal is passed via an amplifier 1601 applying a $g_{dry}$ gain to a head related transfer function (HRTF) interpolator 1605. The HRTF interpolator 1605 may comprise a set of head-related transfer functions (HRTF) in a database and from which HRTF filter coefficients are selected based on the direction of arrival input. The input signal may then be convolved with the interpolated HRTF to generate a left and right HRTF output which is passed to a left output combiner 1641 and a right output combiner 1643.

The lower path of FIG. 6 shows the input signal being passed via a second amplifier 1603 applying a $g_{wet}$ gain to a number of decorrelator paths. In the example shown in FIG. 6 there are shown two decorrelator paths, however it is understood that any number of decorrelator paths may be implemented. The decorrelator paths may comprise a decorrelator amplifier 1611, 1621 which is configured to apply a decorrelator gain $g_1$, $g_2$. The decorrelator gains $g_1$, $g_2$ may be determined by a gain determiner 1631.

The decorrelator path may further comprise a decorrelator 1613, 1623 configured to receive the output of the decorrelator amplifier 1611, 1621 and decorrelate the signals. The decorrelator 1613, 1623 can basically be any kind or type of decorrelator. For example a decorrelator configured to apply different delays at different frequency bands, as long as there is a pre-delay in the beginning of the decorrelator. This delay should be at least 2 ms (i.e., when the summing localization ends, and the precedence effect starts).

The decorrelator path may further comprise a HRTF filter 1615, 1625 configured to receive the output of the decorrelator 1613, 1623 and apply a predetermined HRTF. In other words the decorrelated signals are convolved with predetermined HRTFs, which are selected to cover the whole sphere around the listener. In some embodiments an example number of the decorrelator paths is 12 (but may be in some embodiments between about 6 and 20).

Each decorrelator path may then output a left and right path channel audio signal to the left output combiner 1641 and a right output combiner 1643.

The left output combiner 1641 and a right output combiner 1643 may be configured to receive the 'wet' and 'dry' path audio signals and combine them to generate a left output signal and a right output signal.

The gain determiner 1631 may be configured to determine a gain $g_i$ for each decorrelator path based on the direction of the source, for example using the following expression:

$$g_i=0.5+0.5(S_xD_{x,i}+S_yD_{y,i}+S_zD_{z,i})$$

where $S=[S_x\ S_y\ S_z]$ is the direction vector of the source and $D_i[D_{x,i}\ D_{y,i}\ D_{z,i}]$ is the direction vector of the HRTF in the decorrelator path i.

In some embodiments the amplifier 1601 applying a $g_{dry}$ gain and the second amplifier 1603 applying a $g_{wet}$ gain may be controlled such that the gain for the "dry" and the "wet" paths can be selected based on how "much" externalization is desired. The ratio of the gains affect the perceived distance of the auditory object. In practice, it has been noticed that good values include $g_{dry}=0.92$ and $g_{wet}=0.18$. It should be noted that the number of decorrelator paths furthermore affects the suitable value for $g_{wet}$.

Furthermore, as the ratio between $g_{dry}$ and $g_{wet}$ affects the perceived distance, controlling them can be used for controlling the perceived distance.

Figure 8:
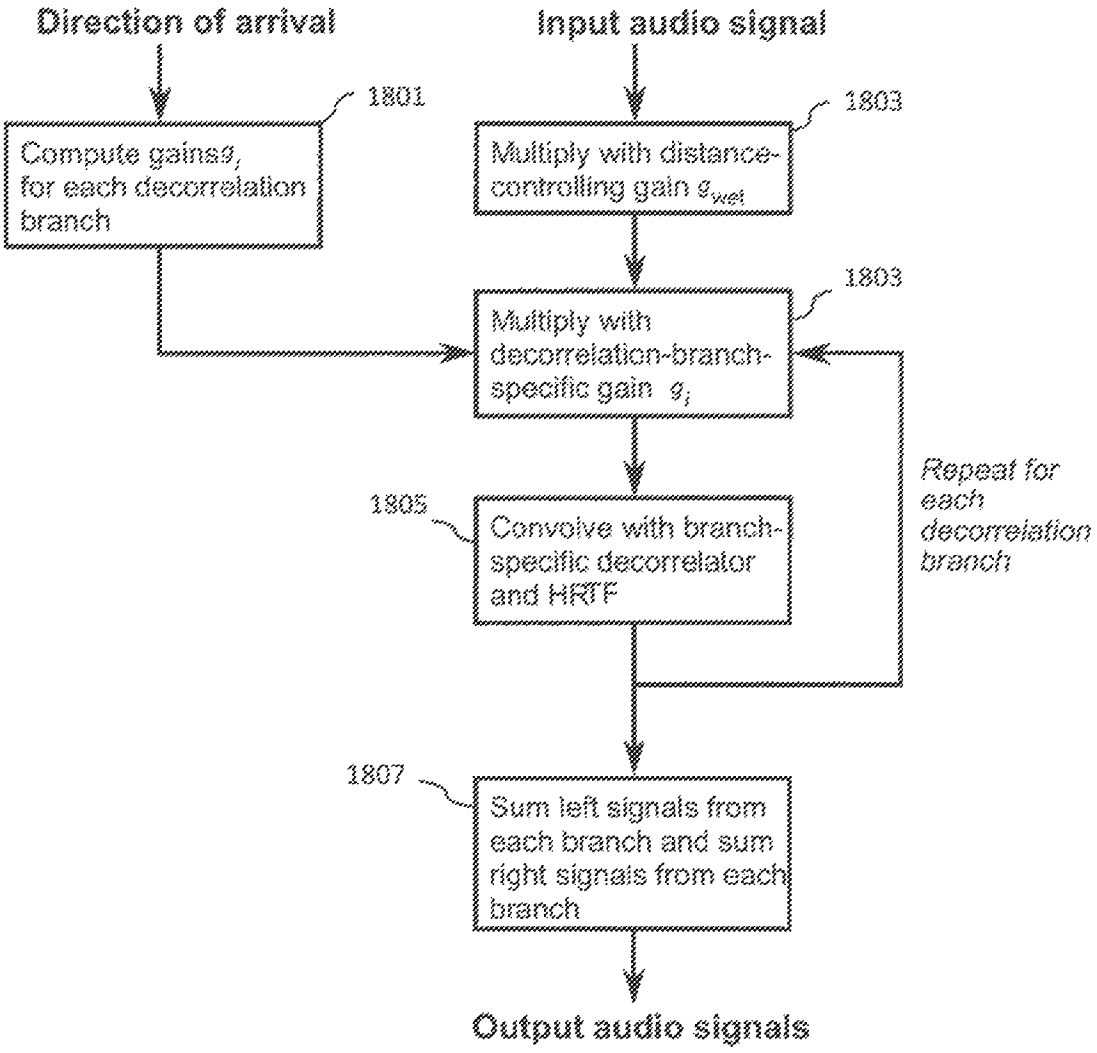
FIG. 8 shows a flow diagram of the operation of the rendering apparatus shown in FIG. 6 according to some embodiments.

The operations of the lower path of FIG. 6 are shown in FIG. 8.

The method of the lower path may comprise receiving the direction of arrival parameter.

The method may the further comprise computing or determining the decorrelator amplifier gains $g_i$ for each decorrelation path or branch.

The operation of computing or determining the decorrelator amplifier gains $g_i$ for each decorrelation path or branch is shown in FIG. 8 by step 1801.

Furthermore in some embodiments in parallel with the receiving the direction of arrival parameter the method furthermore comprises receiving the input audio signal.

The method may further comprise multiplying the received audio signal by the distance controlling gain $g_{wet}$.

The operation of multiplying the input audio signal with the distance controlling gain $g_{wet}$ is shown in FIG. 8 by step 1803.

The method may furthermore comprise multiplying the output of the previous step with the decorrelation-branch or decorrelation-path specific gain calculated in step 1801.

The operation of multiplying the output of the previous step with the decorrelation-branch or decorrelation-path specific gain is shown in FIG. 8 by step 1803.

The method may furthermore comprise convolving the output of the previous step with the branch (or path) specific decorrelator and applying the decorrelation branch or path predetermined HRTF.

The operation of convolving the decorrelation branch specific amplifier output with the branch (or path) specific decorrelator and applying the decorrelation branch or path predetermined HRTF is shown in FIG. 8 by step 1805.

The steps of multiplying the output of the previous step with the decorrelation-branch or decorrelation-path specific gain and convolving the output with the branch (or path) specific decorrelator and applying the decorrelation branch or path predetermined HRTF may then be repeated for each decorrelation branch as shown by the loop arrow.

The outputs of each branch left signals may be summed and the outputs of each branch right signals may be summed to be further combined with the 'dry' binaural left and right audio signals to generate a pair of output signals The operation of summing each branch left signals and summing each branch right signals is shown in FIG. 8 by step 1807.

Figure 9:
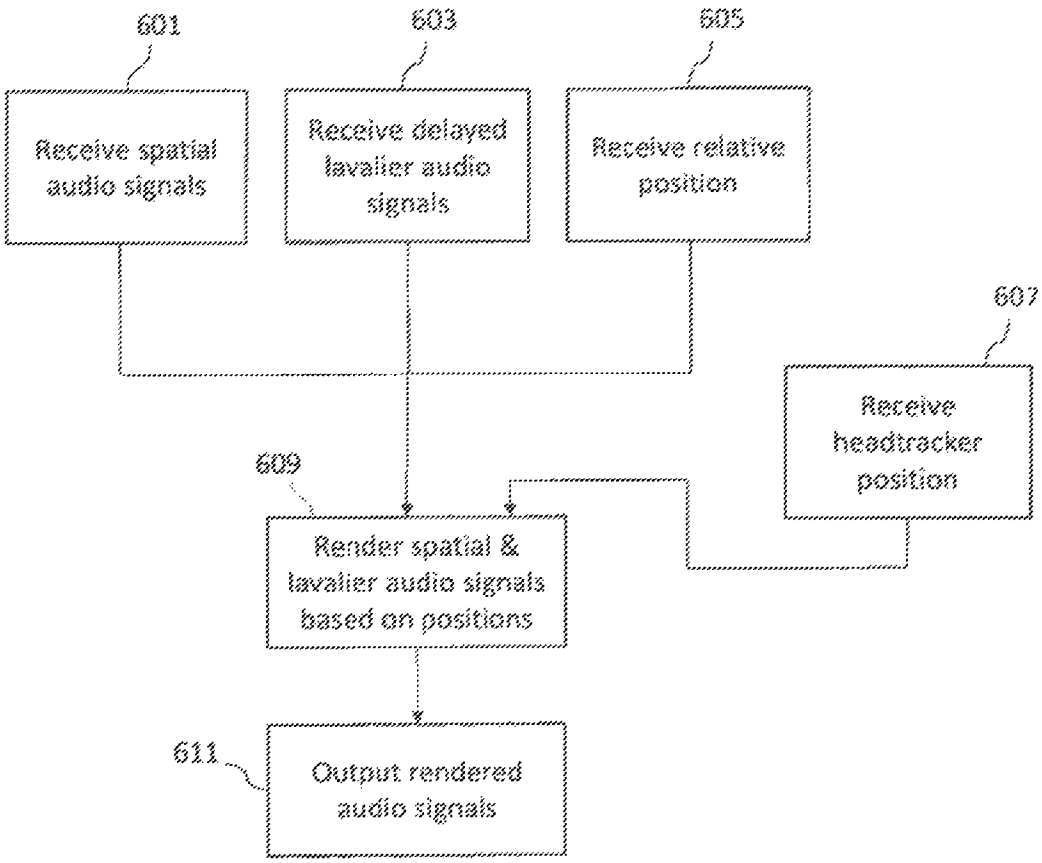
FIG. 9 shows a flow diagram of the operation of the rendering apparatus shown in FIG. 1 according to some embodiments and FIG. 10 shows schematically an example device suitable for implementing the capture and/or render apparatus shown in FIG. 1.

FIG. 9 shows the audio renderer configured to render the full output. The full output in this example comprising one or more Lavalier signals and in this example two Lavalier signals and furthermore comprising the output of the spatial audio signal in a 5.1. multichannel signal format.

In the example audio renderer shown there are seven renderers of which five binaural renderers are shown. Each binaural renderer may be similar to the binaural renderer example shown in FIG. 6 configured to render a single or mono channel audio signal. In other words each of the binaural renders 1701, 1703, 1705, 1707, and 1709 may be the same apparatus as shown in FIG. 6 but with a different set of inputs such as described herein.

Figure 7:
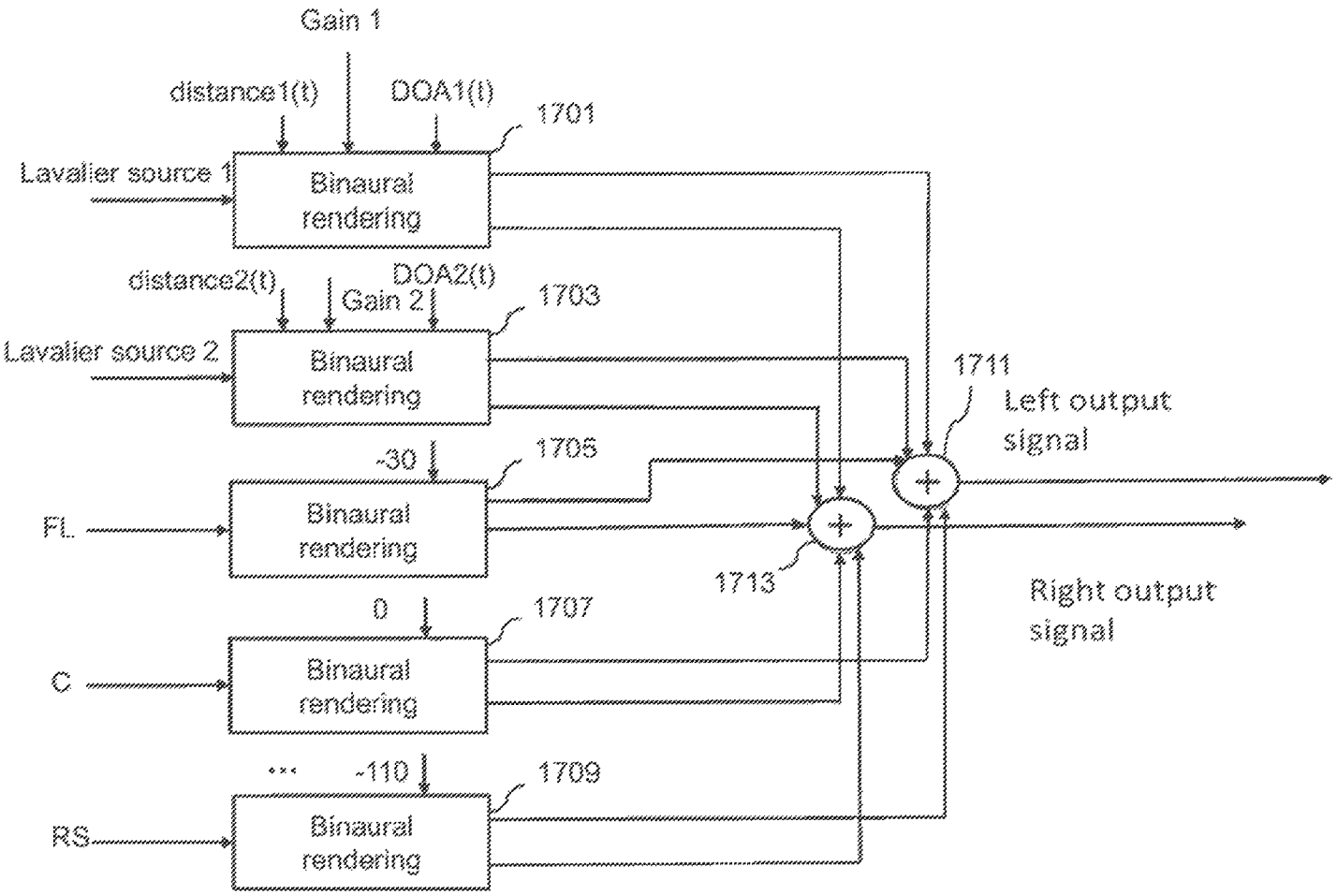
FIG. 7 shows schematically a further example rendering apparatus as shown in FIG. 1 according to some embodiments.

In the example shown in FIG. 7 there are two Lavalier sourced audio signals. For the Lavalier signals, the direction of arrival information is time-dependent, and obtained from the positioning methods as described herein. Moreover, the determined distance between the Lavalier microphone and the microphone array for capturing the spatial audio signal is used to control the ratio between the 'direct/dry' and 'wet' paths, with a larger distance increasing the proportion of the "wet" path and decreasing the proportion of "direct/dry". Correspondingly, the distance may affect the gain of the Lavalier source, with shorter distance increasing the gain and a larger distance decreasing the gain. The user may furthermore be able to adjust the gain of Lavalier sources. In some embodiments the gain may be set automatically. In the case of automatic gain adjustment, the gain may be matched such that the energy of the Lavalier source matches some desired proportion of the total signal energy. Alternatively or in addition to, in some embodiments the system may match the loudness of each Lavalier signal such that it matches the average loudness of other signals (Lavalier signals and multichannel signals).

Thus in some embodiments the inputs to a first Lavalier source binaural renderer 1701 are the audio signal from the first Lavalier microphone, the distance from the first Lavalier microphone to the microphone array for capturing the spatial audio signals, the first gain for signal energy adjustment or for focusing on the source, and a first direction of arrival based on the orientation between the first Lavalier microphone to the microphone array for capturing the spatial audio signals. As described herein the first direction of arrival may be further based on the user input such as from the head tracker.

Furthermore in some embodiments the inputs to a second Lavalier source binaural renderer 1703 are the audio signal from the second Lavalier microphone, the distance from the second Lavalier microphone to the microphone array for capturing the spatial audio signals, the second gain for signal energy adjustment or for focusing on the source, and a second direction of arrival based on the orientation between the second Lavalier microphone to the microphone array for capturing the spatial audio signals. As described herein the second direction of arrival may be further based on the user input such as from the head tracker.

Furthermore there are 5 further binaural renderers (of which the front left, center and rear surround (or rear right) are shown. The spatial audio signal is therefore represented in a 5.1 multichannel format and each channel omitting the low-frequency channel is used as a single audio signal input to a respective binaural renderer. Thus, the signals and their directions of arrival are front-left: 30 degrees
center: 0 degrees
front-right −30 degrees
rear-left: 110 degrees
rear-right: −110 degrees The output audio signals from each of the renderers may then be combined by a left channel combiner 1711 and a right channel combiner 1713 to generate the binaural left output channel audio signal and the right output channel audio signal.

It is noted that the above is an example only. For example, the Lavalier sources and the spatial audio captured by the SPAC might be rendered differently.

For example, a binaural downmix may be obtained of the spatial audio and each of the Lavalier signals, and these could then be mixed. Thus, in these embodiments the captured spatial audio signal is used to create a binaural downmix directly from the input signals of the microphone array, and this is then mixed with a binaural mix of the Lavalier signals.

In some further embodiments, the Lavalier audio signals may be upmixed to a 5.1. multichannel output format using amplitude panning techniques.

Furthermore in some embodiments the spatial audio could also be represented in any other channel-based format such as 7.1 or 4.0. The spatial audio might also be represented in any known object-based format, and stored or transmitted or combined with the Lavalier signals to create an object-based representation.

In some embodiments the (time delayed) audio signal from the close microphone may be used as a mid-signal (M) component input. Similarly the spatial audio signal used as the side-signal (S) component input. The position or tracking information may be used as the direction information ($\alpha$) input. In such a manner any suitable spatial processing applications implementing the mid-side-direction (M-S-$\alpha$) spatial audio convention may be employed using the audio signals. For example spatial audio processing such as featured in US20130044884 and US2012128174 may be implemented.

Similarly the audio renderer 121 may employ rendering methods and apparatus such as featured in known spatial processing (such as those explicitly featured above) to generate suitable binaural or other multichannel audio format signals.

The audio renderer 121 thus in some embodiments may be configured to combine the audio signals from the close or Lavalier sources and the audio signals from the microphone array. These audio signals may be combined to a single binaural output which can be listened through headphones.

With respect to FIG. 6 a summary of the operations of the render apparatus 103 is shown in further detail.

The render apparatus 103 in some embodiments is configured to receive the spatial audio signals.

The operation of receiving the spatial audio signals is shown in FIG. 6 by step 601.

The render apparatus 103 in some embodiments is configured to receive the time delayed Lavalier microphone audio signals.

The operation of receiving the time delayed Lavalier microphone audio signals is shown in FIG. 6 by step 603.

The render apparatus 103 in some embodiments is configured to receive the tracked relative position information.

The operation of receiving the tracked relative position information is shown in FIG. 6 by step 605.

The render apparatus 103 in some embodiments is configured to receive or determine head tracker position information.

The operation of receiving the head tracker position information is shown in FIG. 6 by step 607.

The render apparatus 103 may then in some embodiments generate a suitable mixing of the spatial and Lavalier microphone audio signals using the tracked relative position information and the head tracking position information.

The operation of generating a suitable mixing of the spatial and Lavalier microphone audio signals using the tracked relative position information and the head tracking position information is shown in FIG. 6 by step 609.

Furthermore the render apparatus 103 may then output the mixed audio signals to the output, for example the headphones worn by the listener.

The operation of outputting the rendered mixed audio signal is shown in FIG. 6 by step 611.

Figure 10:
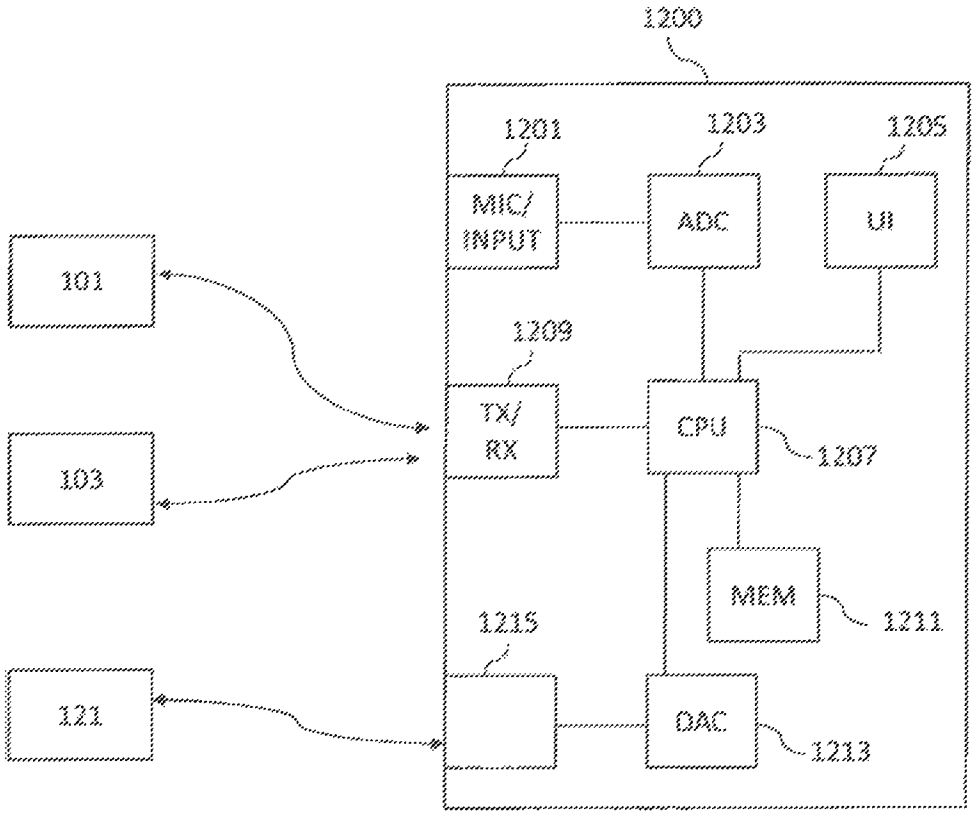

With respect to FIG. 10 an example electronic device which may be used as the SPAC device is shown. The device may be any suitable electronics device or apparatus. For example in some embodiments the device 1200 is a mobile device, user equipment, tablet computer, computer, audio playback apparatus, etc.

The device 1200 may comprise a microphone array 1201. The microphone array 1201 may comprise a plurality (for example a number N) of microphones. However it is understood that there may be any suitable configuration of microphones and any suitable number of microphones. In some embodiments the microphone array 1201 is separate from the apparatus and the audio signals transmitted to the apparatus by a wired or wireless coupling. The microphone array 1201 may in some embodiments be the SPAC microphone array 113 as shown in FIG. 1.

The microphones may be transducers configured to convert acoustic waves into suitable electrical audio signals. In some embodiments the microphones can be solid state microphones. In other words the microphones may be capable of capturing audio signals and outputting a suitable digital format signal. In some other embodiments the microphones or microphone array 1201 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphones can in some embodiments output the audio captured signal to an analogue-to-digital converter (ADC) 1203.

The SPAC device 1200 may further comprise an analogue-to-digital converter 1203. The analogue-to-digital converter 1203 may be configured to receive the audio signals from each of the microphones in the microphone array 1201 and convert them into a format suitable for processing. In some embodiments where the microphones are integrated microphones the analogue-to-digital converter is not required. The analogue-to-digital converter 1203 can be any suitable analogue-to-digital conversion or processing means. The analogue-to-digital converter 1203 may be configured to output the digital representations of the audio signals to a processor 1207 or to a memory 1211.

In some embodiments the device 1200 comprises at least one processor or central processing unit 1207. The processor 1207 can be configured to execute various program codes. The implemented program codes can comprise, for example, SPAC control, position determination and tracking and other code routines such as described herein.

In some embodiments the device 1200 comprises a memory 1211. In some embodiments the at least one processor 1207 is coupled to the memory 1211. The memory 1211 can be any suitable storage means. In some embodiments the memory 1211 comprises a program code section for storing program codes implementable upon the processor 1207. Furthermore in some embodiments the memory 1211 can further comprise a stored data section for storing data, for example data that has been processed or to be processed in accordance with the embodiments as described herein. The implemented program code stored within the program code section and the data stored within the stored data section can be retrieved by the processor 1207 whenever needed via the memory-processor coupling.

In some embodiments the device 1200 comprises a user interface 1205. The user interface 1205 can be coupled in some embodiments to the processor 1207. In some embodiments the processor 1207 can control the operation of the user interface 1205 and receive inputs from the user interface 1205. In some embodiments the user interface 1205 can enable a user to input commands to the device 1200, for example via a keypad. In some embodiments the user interface 205 can enable the user to obtain information from the device 1200. For example the user interface 1205 may comprise a display configured to display information from the device 1200 to the user. The user interface 1205 can in some embodiments comprise a touch screen or touch interface capable of both enabling information to be entered to the device 1200 and further displaying information to the user of the device 1200.

In some implements the device 1200 comprises a transceiver 1209. The transceiver 1209 in such embodiments can be coupled to the processor 1207 and configured to enable a communication with other apparatus or electronic devices, for example via a wireless communications network. The transceiver 1209 or any suitable transceiver or transmitter and/or receiver means can in some embodiments be configured to communicate with other electronic devices or apparatus via a wire or wired coupling.

For example as shown in FIG. 10 the transceiver 1209 may be configured to communicate with the render apparatus 103.

The transceiver 1209 can communicate with further apparatus by any suitable known communications protocol. For example in some embodiments the transceiver 209 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the device 1200 may be employed as a render apparatus. As such the transceiver 1209 may be configured to receive the audio signals and positional information from the capture apparatus 101, and generate a suitable audio signal rendering by using the processor 1207 executing suitable code. The device 1200 may comprise a digital-to-analogue converter 1213. The digital-to-analogue converter 1213 may be coupled to the processor 1207 and/or memory 1211 and be configured to convert digital representations of audio signals (such as from the processor 1207 following an audio rendering of the audio signals as described herein) to a suitable analogue format suitable for presentation via an audio subsystem output. The digital-to-analogue converter (DAC) 1213 or signal processing means can in some embodiments be any suitable DAC technology.

Furthermore the device 1200 can comprise in some embodiments an audio subsystem output 1215. An example as shown in FIG. 7 the audio subsystem output 1215 is an output socket configured to enabling a coupling with the headphones 121. However the audio subsystem output 1215 may be any suitable audio output or a connection to an audio output. For example the audio subsystem output 1215 may be a connection to a multichannel speaker system.

In some embodiments the digital to analogue converter 1213 and audio subsystem 1215 may be implemented within a physically separate output device. For example the DAC 1213 and audio subsystem 1215 may be implemented as cordless earphones communicating with the device 1200 via the transceiver 1209.

Although the device 1200 is shown having both audio capture and audio rendering components, it would be understood that in some embodiments the device 1200 can comprise just the audio capture or audio render apparatus elements.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. Apparatus comprising:

at least one processor, and at least one non-transitory memory including computer program code, the at least one memory and the computer program code configured to, with the at least one processor, causes the apparatus at least to:

receive a spatial audio signal associated with a microphone array configured to provide spatial audio capture and at least one additional audio signal associated with an additional microphone, the at least one additional audio signal having been delayed with a variable delay determined such that the spatial audio signal and the at least one additional audio signal are time aligned;

receive a relative position between a first position associated with the microphone array and a second position associated with the additional microphone;

generate at least two output audio channel signals with processing and mixing the spatial audio signal and the at least one additional audio signal based on the relative position between the first position and the second position such that the at least two output audio channel signals present an augmented audio scene.

2. The apparatus as claimed in claim 1, wherein the apparatus is configured to mix and process the spatial audio signal and the at least one additional audio signal such that a source captured with the spatial audio signal and the at least one additional audio signal is enhanced.

3. The apparatus as claimed in claim 1, wherein the apparatus is configured to mix and process the spatial audio signal and the at least one additional audio signal such that a spatial positioning of a source captured with the spatial audio signal and the at least one additional audio signal is changed for playback audio.

4. The apparatus as claimed in claim 1, wherein the apparatus configured to generate the at least two output audio channel signals with processing and mixing the spatial audio signal and the at least one additional audio signal based on a relative position between the first position and the second position is further configured to combine the spatial audio signal and the at least one additional audio signal in a ratio defined with a distance defined at the relative position between the first position associated with the microphone array and the second position associated with the additional microphone.

5. The apparatus as claimed in claim 1, wherein the apparatus configured to generate the at least two output audio channel signals is configured to generate at least one binaural rendering of the at least one additional audio signal with being further configured to:

determine a head related transfer function based on the relative position;

apply the head related transfer function to the at least one additional audio signal to generate a first pair of binaural audio signals;

apply a plurality of fixed further head related transfer functions to a decorrelated additional audio signal to generate further pairs of binaural audio signals; and combine the first and further pairs of binaural audio signals to generate the at least one binaural rendering of the at least one additional audio signal.

6. The apparatus as claimed in claim 5, wherein the apparatus configured to apply the head related transfer function to the at least one additional audio signal to generate a first pair of binaural audio signals is further configured to apply a direct gain to the at least one additional audio signal before the application of the head related transfer function and the processor configured to apply a plurality of fixed further head related transfer functions is further configured to apply a wet gain to the at least one additional audio signal before the application of the plurality of the fixed further head related transfer functions.

7. The apparatus as claimed in claim 6, wherein the apparatus is configured to determine a ratio of the direct gain to the wet gain based on the distance between the first position and the second position.

8. The apparatus as claimed in claim 5, wherein the apparatus configured to generate the at least two output audio channel signals is further configured to generate at least one binaural rendering of the spatial audio signal with being further configured to:

determine the head related transfer function based on a spatial audio signal channel orientation;

apply the head related transfer function to a spatial audio signal associated with the spatial audio signal channel orientation to generate a first pair of binaural spatial audio signals;

apply a plurality of fixed further head related transfer functions to a decorrelated spatial audio signal associated with the spatial audio signal channel orientation to generate further pairs of binaural spatial audio signals; and combine the first and further pairs of binaural spatial audio signals to generate the at least one binaural rendering of the spatial audio signal.

9. The apparatus as claimed in claim 8, wherein the apparatus configured to generate the at least two output audio channel signals is further configured to generate a binaural rendering for each channel of the spatial audio signal.

10. The apparatus as claimed in claim 8, wherein the apparatus configured to generate the at least two output audio channel signals is further configured to combine the at least one binaural rendering of the spatial audio signal and the at least one binaural rendering of the at least one additional audio signal.

11. The apparatus as claimed in claim 1, wherein the variable delay between the spatial audio signal and at least one additional audio signal such that the audio signals are time aligned enables the restoration of synchronisation between the spatial audio signal and the at least one additional audio signal.

12. The apparatus as claimed in claim 1, wherein the apparatus is a render apparatus.

13. Apparatus comprising:

at least one processor, and at least one non-transitory memory including computer program code, the at least one memory and the computer program code configured to, with the at least one processor, cause the apparatus at least to:

receive a spatial audio signal captured with a microphone array at a first position configured to provide spatial audio capture;

receive at least one additional audio signal captured with an additional microphone at a second position;

determine and track a relative position between the first position and the second position;

determine a variable delay between the spatial audio signal and at least one additional audio signal for the audio signals to be time aligned;

apply the variable delay to the at least one additional audio signal to substantially align the spatial audio signal and the at least one additional audio signal.

14. The apparatus as claimed in claim 13, wherein the variable delay between the spatial audio signal and at least one additional audio signal such that the audio signals are time aligned enables the restoration of synchronization between the spatial audio signal and the at least one additional audio signal.

15. Currently amended) The apparatus as claimed in claim 13, wherein the apparatus is further configured to output or store:

the spatial audio signal;

the at least one additional audio signal delayed with the variable delay; and the relative position between the first position and the second position.

16. The apparatus as claimed in claim 13, wherein the microphone array is associated with a first position tag identifying the first position, and the additional microphone is associated with a second position tag identifying the second position, wherein the processor configured to determine and track a relative position is configured to determine the relative position based on a comparison of the first position tag and the second position tag.

17. The apparatus as claimed in claim 13, wherein the apparatus configured to determine the variable delay is configured to determine a maximum correlation value between the spatial audio signal and the at least one additional audio signal and determine the variable delay as a time value associated with the maximum correlation value.

18. The apparatus as claimed in claim 13, wherein the processor configured to determine and track a relative position between the first position and the second position is configured to:

determine the first position defining the position of the microphone array;

determine the second position defining the position of the at least one additional microphone;

determine a relative distance between the first position and the second position; and determine at least one orientation difference between the first position and the second position.

19. A method comprising:

receiving a spatial audio signal associated with a microphone array configured to provide spatial audio capture and at least one additional audio signal associated with an additional microphone, the at least one additional audio signal having been delayed with a variable delay determined such that the spatial audio signal and the at least one additional audio signal are time aligned;

receiving a relative position between a first position associated with the microphone array and a second position associated with the additional microphone;

generating at least two output audio channel signals with processing and mixing the spatial audio signal and the at least one additional audio signal based on the relative position between the first position and the second position such that the at least two output audio channel signals present an augmented audio scene.

20. A method comprising:

determining a spatial audio signal captured with a microphone array at a first position configured to provide spatial audio capture;

determining at least one additional audio signal captured with an additional microphone at a second position;

determining and tracking a relative position between the first position and the second position;

determining a variable delay between the spatial audio signal and at least one additional audio signal for the audio signals to be time aligned;

applying the variable delay to the at least one additional audio signal to substantially align the spatial audio signal and the at least one additional audio signal.

* * * * *